US008544410B2

(12) United States Patent
Tanioka et al.

(10) Patent No.: US 8,544,410 B2
(45) Date of Patent: Oct. 1, 2013

(54) IMMOBILIZATION APPARATUS

(75) Inventors: Akihiko Tanioka, Tokyo (JP); Kozo Inoue, Wako (JP); Kazuya Nitta, Wako (JP); Masaru Tamaru, Tokyo (JP)

(73) Assignees: Akihiko Tanioka, Tokyo (JP); Fuence Co., Ltd., Saitama (JP); Hit Co., Ltd., Tokyo (JP)

( * ) Notice: Subject to any disclaimer, the term of this patent is extended or adjusted under 35 U.S.C. 154(b) by 339 days.

(21) Appl. No.: 12/734,516

(22) PCT Filed: Nov. 6, 2008

(86) PCT No.: PCT/JP2008/070205
§ 371 (c)(1),
(2), (4) Date: Sep. 14, 2010

(87) PCT Pub. No.: WO2009/060898
PCT Pub. Date: May 14, 2009

(65) Prior Publication Data

US 2011/0017134 A1 Jan. 27, 2011

(30) Foreign Application Priority Data

Nov. 7, 2007 (JP) ..... 2007-289921

(51) Int. Cl.
*B05B 5/025* (2006.01)
*B05C 11/00* (2006.01)

(52) U.S. Cl.
USPC ..... 118/629; 118/692; 118/666; 118/667

(58) Field of Classification Search
USPC ..... 118/58, 62, 63
See application file for complete search history.

(56) References Cited

U.S. PATENT DOCUMENTS

| | | | | |
|---|---|---|---|---|
| 3,896,994 | A * | 7/1975 | Walberg | 239/3 |
| 4,344,381 | A * | 8/1982 | Ostrowski et al. | 118/626 |
| 4,748,043 | A * | 5/1988 | Seaver et al. | 427/482 |
| 4,761,299 | A * | 8/1988 | Hufstetler et al. | 427/483 |
| 5,298,277 | A * | 3/1994 | Hirose | 427/8 |
| 5,738,728 | A * | 4/1998 | Tisone | 118/638 |
| 6,037,012 | A * | 3/2000 | Lourman | 427/475 |
| 6,331,330 | B1 * | 12/2001 | Choy et al. | 427/475 |
| 2004/0177807 | A1 * | 9/2004 | Pui et al. | 118/303 |

FOREIGN PATENT DOCUMENTS

| | | |
|---|---|---|
| JP | 35-10765 | 5/1960 |
| JP | 2005-281679 | 10/2005 |
| JP | 2006-22463 | 1/2006 |
| WO | WO 2004/074172 | 9/2004 |

OTHER PUBLICATIONS

Yamagata, et al., "Electrospray—ho ni yoru Biochip no Sosei" Feb. 20, 2004.
Ishiguro, et al., "Electrospray—ho ni yoru Carbonfiber Fabric no Sakusei" Oct. 26, 2007.

* cited by examiner

*Primary Examiner* — Yewebdar Tadesse
(74) *Attorney, Agent, or Firm* — Farjami & Farjami LLP

(57) ABSTRACT

The invention is an immobilization apparatus comprising: a container (1) having a nozzle (4) formed for exhausting a solution; a charging means (PS, 5, 4) for charging the sample solution within the container; and an airflow generating means for generating airflow (Af) crashing into the sample solution. The immobilization apparatus is configured to operate the charging means and the airflow generating means simultaneously, atomize the solution into microparticulate substances charged while maintaining its activity and functionality by the electrostatic force due to the charge of the sample solution charged by the charging means and the crash energy due to the crash of the airflow generated by the airflow generating means into the sample solution, and exhaust it from the exhaust outlet (4), and the charged microparticulate substances are deposited on a substrate (7) by the electrostatic force.

27 Claims, 19 Drawing Sheets

IMMOBILIZATION APPARATUS

This is a U.S. national phase application which is based on, and claims priority from, PCT application Serial No. PCT/JP2008/070205, filed Nov. 6, 2008, which claims priority from foreign application Serial No. 2007-289921, filed Nov. 7, 2007 in Japan.

TECHNICAL FIELD

This invention relates to an immobilization apparatus.

BACKGROUND ART

In recent years, a thin film of immobilized biologic polymer, functional polymer, organic polymer or the like has been broadly used in an extraordinary variety of applications in high demand such as analytical instruments like a biochip, a biosensor and so on, various display devices, an optical element, a semiconductor element and the like. Although a variety of apparatus and methods for forming such a thin film have been invented and practiced heretofore, the conventional apparatus and methods are not necessarily suitable for forming a thin film by immobilizing a biologic polymer, a functional polymer or the like while maintaining its activity for the following reasons. For example, a spattering apparatus, an EB resistance heating deposition apparatus, a CVD apparatus and the like are put into practical use for forming a thin film of metal or a thin film of inorganic compound. However, since these apparatus are exposed to a plasma or a high heat under a strong vacuum, it is hardly possible to form a thin film by immobilizing a biologic polymer, an organic polymer and the like while maintaining the activity.

An electrostatic coating apparatus is a method of spraying a liquid by pressurized air and adding the electrostatic force thereto so as to provide the attachment to a substrate, and is used for coating and the like. The apparatus, however, requires a huge amount of liquid for the spray by pressurized air and incurs a lot of waste, so is not suitable for forming of a small amount of film of functional polymer or biologic polymer. Moreover, since the diameter of an atomized liquid drop is extremely large in the spray by pressurized air, the liquid drop reaches the substrate without being dried. Thereby, it takes a long time to dry on the substrate, and a biologic polymer, which is easily denaturalized, is liable to lose the activity in the drying process taking such a long time. Therefore, it is difficult to form a film by immobilizing such a substance being easily denaturalized while maintaining the activity with the electrostatic coating apparatus.

A spotting coating apparatus is an apparatus for forming a thin film by applying a liquid onto a substrate with a metal chip or a coater capable of holding a liquid in its micro gap, like the needle gap of a fountain pen, and drying it thereafter. This apparatus also has a lot of problems in forming a film of biologic polymer being more likely to lose the activity, an expensive organic polymer or the like for the same reason, i.e. since the drying time takes long or a lot of materials are wasted.

An inkjet method is a method for forming a thin film by injecting a solvent of the objective functional polymer or the like dissolved therein as a small liquid drop from a nozzle, providing the attachment to a substrate, and drying it. However, it is also difficult to form a thin film by immobilizing a functional polymer or the like while maintaining the activity by this method for the same reason as above, i.e. since the drying time takes long.

An ESD method is a method for forming a thin film by depositing a sample by electrospray (electrostatic atomization) (See Patent Document 1: International Publication No. WO98/58745). This ESD method is more suitable for forming a thin film of biologic polymer or the like than the other methods and apparatus for forming a thin film mentioned above, and is capable of forming a thin film without losing the activity of a biologic polymer or the like under certain conditions. There is, however, a problem in this method that it is difficult to spray a solution with high electric conductivity and the kinds of formable thin films are limited (See Non-patent Document 1: Analytical Chemistry 73, p 2183-2189, 2001). Particularly, a biologic polymer such as a protein is generally dissolved in a buffer solution for keeping pH constant and the electric conductivity is large to be not less than approximately 1000 μS, thereby it is difficult to form a spot or a film by immobilizing it as it is by the ESD method. Also, since a protein and the like lose the activity rapidly in a short time when a stabilizer such as a buffer is removed, the operation for forming a thin film needs to be conducted in a short time and the operating efficiency is down in the case of such a sample. Moreover, there is a problem in that the activity deteriorates even though a thin film can be formed. Furthermore, since the ESD method requires a sample to be almost completely dissolved in a solution for passing through a hole on the tip of a capillary, it is difficult to use a sample being difficult to be dissolved, such as a particle. Additionally, in the ESD method, which is in the form of atomizing microparticles only by the electrostatic force, the atomization rate is very low and the immobilization rate is also very low accordingly.

On the other hand, it is well known that an atomization apparatus using various oscillators has been developed and used in various applications, and an immobilization technique for atomization by oscillation and the electrostatic force in the combination of such a oscillator technique and the ESD method is disclosed (See Patent Document 2: Japanese Patent Application Laid-open Publication No. 2003-136005).

DISCLOSURE OF THE INVENTION

Problem to be Solved by the Invention

However, this immobilization technique has problems in that a liquid drop is larger than the ESD method, the collection efficiency is not high and the like. Also, although the atomization rate of this immobilization technique has significantly improved when compared to the ESD method, it is not yet sufficient for some applications. Particularly, further improvement of the atomization rate/immobilization rate (atomization amount/immobilization amount) is required for mass production of a thin film with a large area for use in a large screen display apparatus and the like.

In order to deposit and immobilize a biologic polymer (protein, etc.), a functional polymer, an organic polymer or the like to form a spot, a large-area thin film or the like by optimizing a compound, and to maintain its biological activity and functionality, it is required to form a thin film and the like by immobilizing these substances under conditions in which they are less subject to denaturalization and transubstantiation, which is difficult by the conventional methods and apparatus as described above. Although one of the conditions in which a substance is less subject to denaturalization and transubstantiation is to dry a solution containing a biologic polymer and the like extremely rapidly, the evaporation rate of a liquid is generally very slow at normal temperature, and even when a sample solution is stretched by the application onto a substrate and the like, the rate up to the dry state is still slow. Although one of the methods for quickening the drying rate is to heat a solution containing the objective substance, a problem is that most of biologic polymers and organic compounds are denaturalized and transubstantiated by heat and lose the biological activity and functionality.

In a freeze-drying method, as a method for immobilizing a biologic polymer and the like without denaturalizing, it is difficult to maintain the shape of a thin film in a state of being frozen, and normally it becomes powder. Moreover, in the case of a substance such as a biologic polymer and the like required to be dissolved in a buffer solution, and an organic polymer having electric conductivity in its own, the electrospray is difficult due to the large electric conductivity and thereby it is difficult to form a thin film. Namely, in the conventional methods and apparatus, it is extremely difficult to form a thin film having the objective shape and thickness without losing the activity and functionality of a biologic polymer, an organic polymer and the like from a limited amount of substances.

It is, therefore, an object of the invention to solve the above problems and provide a technique for atomizing and immobilizing a sample solution (aqueous solution, inorganic or organic solvent solution) containing a substance being easily denaturalized and transubstantiated such as a biologic polymer, an organic polymer, an inorganic substance or the like (e.g., protein, dye compound, organic compound, functional polymer, etc.) extremely rapidly without damaging its activity (biological activity, etc.) and function.

Means for Solving Problem

For solving the above problems, an immobilization apparatus according to the invention is an immobilization apparatus comprising:

a container for storing a sample solution having at least one exhaust outlet formed for exhausting the sample solution;

a charging means for charging the sample solution within the container; and an airflow generating means for generating airflow crashing into the sample solution, wherein the immobilization apparatus is configured to operate the charging means and the airflow generating means simultaneously, atomize the solution into microparticulate substances charged while maintaining its activity and functionality by the electrostatic force due to the charge of the sample solution charged by the charging means and the crash energy due to the crash of the airflow generated by the airflow generating means into the sample solution, and exhaust it from the at least one exhaust outlet, and further comprises a supporting means for supporting a substrate, where the charged microparticulate substances are to be deposited by the electrostatic force, arranged away from the container.

According to the invention, it becomes possible to atomize and immobilize a sample solution (aqueous solution, inorganic or organic solvent solution) containing a substance being easily denaturalized and transubstantiated such as a biologic polymer, an organic polymer, an inorganic substance or the like (e.g., protein, dye compound, organic compound, functional polymer, etc.) extremely rapidly without damaging its activity (biological activity, etc.) and function.

In one embodiment of the invention, the charging means is provided outside the container and induces a charge by the electrostatic induction to charge the sample solution stored in the container.

Also, in another embodiment of the invention, the airflow generating means generates other airflow larger than the airflow.

Also, in another embodiment of the invention, the immobilization apparatus further comprises a collecting means for collecting the atomized and charged microparticulate substances by the electrostatic force and guiding it to the substrate.

Also, in another embodiment of the invention, the immobilization apparatus further comprises a temperature controlling means for controlling temperature of at least one of the sample solution, the container, the airflow and the substrate.

Also, in another embodiment of the invention, the charging means comprises at least any one of a conductive wire, a conductive thin film, a conductive mesh and an apparatus for emitting charged ions.

Also, in another embodiment of the invention, the immobilization apparatus further comprises a supplying means (pump, etc.) for supplying the sample solution in the container to the exhaust outlet by an arbitrary flow rate and/or an exhausting means for putting pressure on the sample solution stored in the container and exhausting the sample solution from the exhaust outlet by an arbitrary flow rate.

Also, in another embodiment of the invention, the supporting means supports the substrate in an arbitrary direction to the exhaust outlet of the container.

Also, in another embodiment of the invention, the airflow generating means comprises an airflow adjusting means for adjusting at least one of the flow rate, the velocity and the direction of the airflow.

Also, in another embodiment of the invention, the immobilization apparatus further comprises a heating means for heating the solution and/or the airflow. Preferably the heating apparatus increases temperatures of the sample solution supply system, the container and the airflow up to a few hundred degrees. Thereby, it becomes possible to spray a sample without dissolving it in a solvent (so-called thermofusion spray method). In addition, the above-mentioned temperature controlling means may be used as the heating means.

Also, in another embodiment of the invention, the collecting means comprises one or a plurality of convergent electrodes arranged between the exhaust outlet of the container and the substrate. Moreover, the collecting means preferably comprises at least one mask of insulating body or dielectric body arranged between the exhaust outlet of the container and the substrate.

Also, in another embodiment of the invention, the immobilization apparatus further comprises a drying means for drying the particulate substances, wherein the drying means includes a means for supplying dry air to a space where the particulate substances exist and/or a means for depressurizing a space where the particulate substances exist. Namely, the immobilization apparatus further comprises a chassis enclosing a space where the particulate substances exist, and preferably includes a means for supplying dry air to the space or a means for depressurizing the space.

Also, in another embodiment of the invention, at least a portion of the substrate surface is composed of a conductive substance, and the portion is grounded.

Also, in another embodiment of the invention, the at least a portion of the surface of conductive substance is composed of an area with a desired pattern.

Also, in another embodiment of the invention, the container is a capillary, a tank, a box container or a syringe. Also, the exhaust outlet is preferably formed in an arbitrary shape (e.g., shape of a plurality of straight projections, bent projections, circular in the cross section). Also, a gas used in the airflow is preferably air, an inert gas (rare gas) or hot water vapor. Also, the at least one exhaust outlet is preferably a plurality thereof. Also, the container is preferably a plurality thereof.

Also, in another embodiment of the invention, the immobilization apparatus further comprises a guiding means for guiding the airflow to a particular area (area where the particulate substances are desired to be immobilized) on the substrate.

A sample used in an immobilization apparatus according to one embodiment of the invention is a synthetic polymer, an organic polymer, a biologic polymer, an inorganic substance, a metal microparticle or the like.

An immobilization apparatus according to one embodiment of the invention further comprises a moving means (XY stage, conveyer, etc.) for moving the supporting means. By this moving means, the substrate supported by the supporting means is moved and it becomes possible to deposit a sample on another substrate or another location of the substrate.

Also, in another embodiment of the invention, an adjusting means for adjusting the relative positional relationship between the airflow generating means and the exhaust outlet of the container is further provided. Thereby, it becomes possible to modify a position where an exhausted sample solution and airflow crash, considering the property of the sample solution.

Also, in another embodiment of the invention, a driving means for holding the airflow generating means and the container simultaneously and driving on a planar surface parallel to the substrate is further provided. Thereby, it becomes possible to uniform the thickness of a deposited structure.

Also, in another embodiment of the invention, an oscillating means for holding the airflow generating means and the container simultaneously and rotationally driving on an axis parallel to the substrate is further provided. Thereby, it also becomes possible to uniform the thickness of a deposited structure.

Also, in another embodiment of the invention, different sample solutions are stored in the plurality of the containers and media in the different sample solutions are deposited simultaneously on the substrate. By simultaneously atomizing different sample solutions and making it fly to a substrate, different materials are mixed at nano level and deposited uniformly on the substrate. Furthermore, by changing the exhaust rate of different sample solutions by time, a deposit with the gradation of the mixing ratio can be obtained.

Also, in another embodiment of the invention, a structure deposited on the substrate includes at least one of a nanofiber, a nanoparticle and a micropattern.

Also, in another embodiment of the invention, a conductive mask for restricting a depositional area is provided on the substrate in close contact therewith.

Also, in another embodiment of the invention, the container, the charging means, the airflow generating means and the substrate are stored within a case, and the temperature controlling means controls the temperature by heating inside the case.

Also, another embodiment of the invention is an immobilization apparatus comprising:

a container storing a sample solution and having at least one exhaust outlet formed for exhausting the sample solution;

an airflow generating means for crashing airflow into the sample solution exhausted from the container;

a charging means for charging the sample solution; and a grounded substrate, wherein the sample solution is atomized by the electrostatic repulsive force generated from a charge by the charging means and the crash energy of airflow generated from the airflow generating means and the sample solution, and a medium in the sample solution is deposited on the substrate by the electrostatic attraction generated from the potential difference between the charge of the sample solution and the substrate.

Although the means for solving problems according to the invention has been explained as apparatus as described above, it should be understood that the invention can be implemented as methods substantively corresponding thereto and these are included in the scope of the invention. Here, "immobilization" means to form a deposit of for example spot, line, arbitrary pattern, thin film, nonwoven cloth or the like on a substrate from a sample dispersed or dissolved in a solvent in a stable state i.e. in a dry state while maintaining its biological or functional activity.

In an immobilization apparatus according to the invention, a solution surface is disturbed by the crash of high speed airflow into the solution surface, and the solution forms microparticles therefrom and is atomized. When a charge is applied simultaneously at this time, this generation of microparticles is further facilitated and quickly progressed by the repulsive force of the static electricity. Moreover, the formed microparticles never adhere to each other due to this electrostatic repulsive force, and are further microsized into further smaller clusters therein. For such reasons, the high speed ESD spray, which is not possible to implement when a voltage is independently applied, becomes possible and various nano structures can be mass produced. When airflow is independently applied, even though atomization occurs, a nano structure, which is generated from the ESD spray, is not formed. Thus, the synergistic effect of the airflow and the charge is enormous.

Moreover, by the crash of airflow, a solution at the tip portion of a capillary receives the crash energy, and becomes a number of micro liquid drops (liquid particles, particulate substances) to diffuse. Simultaneously, since a high voltage is applied to the solution in advance, the liquid drops are charged and by the electrostatic force, become a number of smaller liquid drops to diffuse. By these crash energy and electrostatic force, the atomized liquid drops change into finer liquid drops in a short time while flying. Namely, these charged fine particulate substances flying out vapor the solvent and water and decrease in particle size while flying towards a grounded substrate or an electrode with the opposite polar character. Moreover, the particulate substances are divided into smaller particulate substances by the electrostatic repulsion inside thereof. Then, it is immobilized on the substrate in a dry state as a deposit. Thus, it is possible to atomize a solution as charged fine particulate substances. In addition, along with the atomization by the electrostatic force of voltage application and the airflow, atomization only by the electrostatic force sometimes occurs simultaneously in the exhaust outlet.

The charged fine particulate substances fly out into the air by the impact due to the electrostatic energy and/or the crash energy. The charged fine particulate substances flying out vapor the solvent and water and decrease in particle size while flying towards a grounded substance or an electrode with the opposite polar character. Moreover, the particulate substances are divided into smaller particulate substances by the electrostatic repulsion inside thereof. Then, it is immobilized on the substrate in a dry state as a deposit.

BEST MODE FOR CARRYING OUT THE INVENTION

Hereinafter, embodiments of the invention will be described in detail with reference to the drawings.

Embodiment 1

Figure 1:
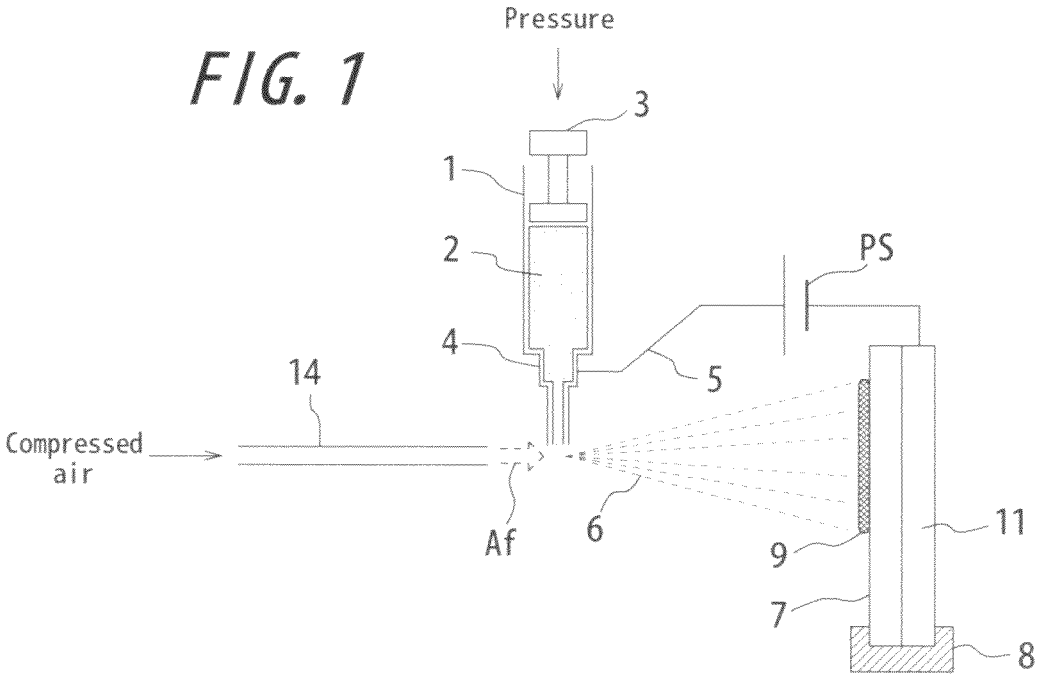
FIG. 1 is a conceptual view showing a basic configuration of an immobilization apparatus according to one embodiment of the invention.

FIG. 1 is a conceptual view showing a basic configuration of an immobilization apparatus according to one embodiment of the invention. As shown, a syringe (container) 1 stores a sample solution 2. The sample solution 2 is, for example a biopolymer solution such as a protein, an organic polymer solution, a polymer solution or the like.

Figure 3:
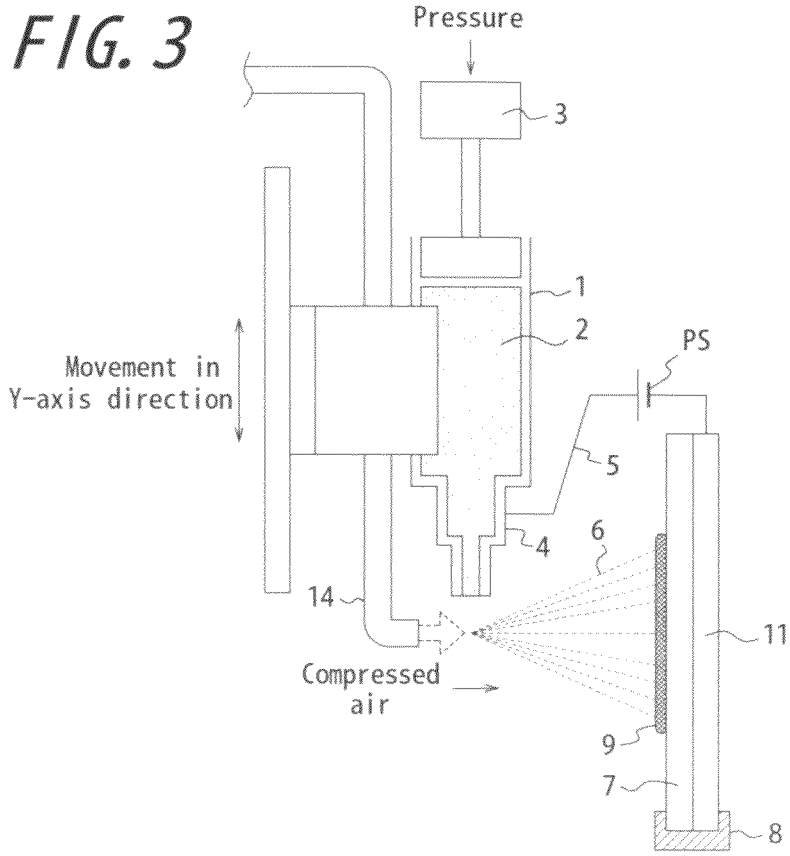
FIG. 3 is a conceptual view (side view) showing a basic configuration of an immobilization apparatus according to another embodiment of the invention.

Also, the sample solution within the syringe 1 receives extrusion pressure at a plunger (exhausting means) 3. The extrusion pressure is applied by a stepping motor and a feed screw mechanism (not shown). The extrusion pressured sample solution 2 increases the inner pressure within the syringe 1, and is exhausted from the tip of a nozzle 4. As mentioned above, by providing a regulating mechanism (stepping motor and feed screw mechanism) for regulating the exhaust rate of a sample solution, it becomes possible to regulate the exhaust rate as appropriate. By such a regulation, it becomes possible to obtain a dry deposit instead of a wet deposit, which is generated at an excessive rate. Namely, it becomes possible to regulate the exhaust rate as the limit at which a wet deposit is not generated. Moreover, in order for mass productivity, by separately providing an additional tank for sample solution and refilling a sample solution from the tank, a longtime operation can become possible. Atomization of a sample solution can be likewise implemented in any of a syringe as shown in FIG. 1, a tank as shown in FIG. 3, a capillary and a box container. The nozzle 4 is made of metal and supplied with a positive voltage from a high voltage power supply PS through a wire 5. The negative side of the high voltage power supply PS is connected to a counter electrode 11. By supplying a voltage from a high voltage power supply, a positive voltage is applied to the sample solution 2 through the nozzle 4 and the solution is positively charged. In addition, the polar character of a voltage applied to the sample solution 2 may be negative.

The sample solution 2 exhausted from the tip of the nozzle 4 crashes into high velocity airflow Af of compressed air (or compressed nitrogen) injected from a tube 14, and the sample solution 2 is atomized by the crash energy to be fine particulate substances. The compressed air with the direction and the velocity regulated by the regulating mechanism (not shown) crashes into the sample solution 2 as airflow (gas) having a certain amount of the kinetic energy. A sample solution itself has a small amount of the kinetic energy corresponding to the exhaust rate and the specific gravity thereof. By the crash energy generated from the crash of the airflow and the sample solution with the kinetic energy, particles of the sample solution 2 overcome the surface tension and fly out from the surface of the sample solution as particles (i.e., atomized as fine particles). When the velocity of compressed air is increased, the crash energy increases and the particle size of an atomized liquid drop decreases. The exhaust rate of a solution can be increased as the velocity of compressed air is increased. Similarly, the particle size of an atomized liquid drop can also be decreased by increasing the exhaust rate of a sample solution from a nozzle or an exhaust outlet. This means that it is possible to produce one deposit (thin film, microstructure of nanofiber or nanoparticle, etc.) in a short time and also reduce the production cost.

The airflow Af released from the tube 14 at this time normally has atmospheric pressure controlled by using a pump or the like. By controlling atmospheric pressure, it is possible to obtain airflow with a continuously stable wind velocity and air volume to thereby obtain deposits with the same property (particle size, etc.). Moreover, it is preferable to approximate the tip of the tube 14 to the immediate vicinity of the nozzle 4 in a distance wise, since application of the airflow Af to the sample solution 2 from the immediate vicinity makes particulization more effective. When compressed air is sent by a pipe joint, an air nozzle, an air gun or the like as substitute for the tube 14, it is possible to focus the gas flow so as to inject the airflow Af with a stable directionality thereof. Other than compressed air, an inert gas, hot water vapor or the like may be used in accordance with the application. The metal nozzle 4 on the tip of the syringe 1 is connected to the wire 5 as mentioned above, and a positive voltage is applied thereto from the external high voltage power supply PS through the wire 5. Eventually, the positive charge is transferred to the sample solution 2 passing through the nozzle 4. The charge to the sample solution 2 can be implemented with a conductive wire, a conductive thin film, a conductive mesh, an apparatus for emitting charged ions or the like except for the metal nozzle. A terminal on the negative side of the high voltage power supply PS is connected to the counter electrode 11 for collecting an atomized sample. Although the polar character of the high voltage power supply PS is set to be positive for the sample solution 2 and negative for the counter electrode 11 in FIG. 1, a deposit can be formed in the same way, even when the polar character of the high voltage power supply is interchanged.

Alternatively, a counter electrode may be simply grounded without application of a negative voltage thereto. When a counter electrode is grounded, the electric potential of a deposit is further grounded, and the advantages are that it is possible to be electrically neutral and eliminate the risk of receiving an electric shock to a person taking out a deposit. Although a counter electrode normally uses a large planer surface, by changing it into a desired shape, it is also possible to form a deposit in that shape. Although the shape of a deposit is usually formed by using a mask to be hereinafter described, when the shape of a counter electrode itself is changed, the handling in setting is easy and it is possible to form a deposit in a desired arbitrary shape while improving the collection efficiency easily.

A particulate substance 6 atomized by the airflow Af flies in a charged state. The particulate substance can be considered to be an aggregate of particles with the same positive charge in a micro wise. Namely, particles with the same positive charge fly towards the counter electrode 11 in a state of being adhered to each other. Since the particles have the same charge, while gradually repelling each other and repeating the division, and being dried, they gradually become fine particulate substances, are attracted to the negative electric potential of the counter electrode 11 and are deposited on the substrate 7 supported by a support portion 8, to be a deposit 9 (or a particular micropattern determined by a spot, a film, a thin film mask, etc.). The support portion 8 has a role of supporting two electric conductors, the substrate 7 and the counter electrode 11 in a state of being closely attached.

According to an immobilization apparatus of the invention, it is possible to atomize a sample solution rapidly to thereby form a thin film extremely rapidly. Also, the deposited/immobilized deposit 9 can be regulated to have a uniform thickness. Moreover, drying of the atomized particulate substance 6 is further promoted by the high velocity airflow Af. Moreover, since a sample can be collected at normal temperature, it is possible to immobilize the sample without losing the activity and/or functionality of the solution. Furthermore, it is possible to easily atomize a solution even with a high viscosity by the extrusion pressure of the plunger 3 and the high velocity airflow Af.

Although a location where a sample/particulate substance is deposited is in the end of a direction in which compressed air flows as shown in FIG. 1, the flying direction of the flying particulate substance 6 may be changed to set an arbitrary location where a sample/particulate substance is deposited, by additionally providing another large airflow generating means. In this case, targets of the two airflow generating means are different, which are one with airflow focused on the tip of a nozzle and another aiming at flying particulate substances. Moreover, in this configuration, in order to adjust temperature, it is also possible to provide a temperature control mechanism for controlling (particularly increasing) temperatures of a container such as a syringe, airflow, and a counter electrode. By heating a container and airflow, it is possible to handle a sample solution, which is unstable and easy to lose the activity or the functionality at low temperature.

Embodiment 2

Figure 2:
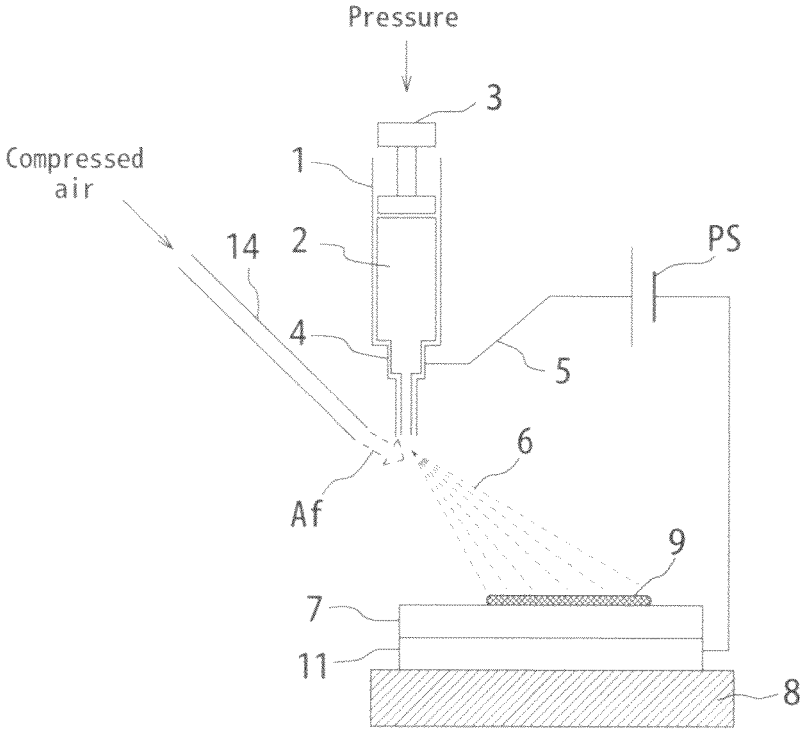
FIG. 2 is a conceptual view showing a basic configuration of an immobilization apparatus according to another embodiment of the invention.

FIG. 2 is a conceptual view showing a basic configuration of an immobilization apparatus according to another embodiment of the invention. Hereinafter, in each figure, the same elements are labeled with the same reference mark and the explanation thereof is omitted. The apparatus in FIG. 2 is different from the one in FIG. 1 in the point that while the direction of the high velocity airflow Af spouts from immediately lateral to a nozzle in FIG. 1, it is configured to spout from obliquely upside in FIG. 2. Atomization is likewise possible from obliquely upside or immediately above as the direction of the airflow Af. In FIG. 2, the airflow Af is crashed into the sample solution 2 positioned in an exhaust outlet EXT from obliquely upside avoiding the syringe 1 to deposit the sample on the level substrate 7. By such an arrangement, it is possible to hit the tip portion of the nozzle 4 with the airflow Af avoiding the syringe 1 so as not to lose the momentum of the airflow Af for efficiently atomization. Moreover, while the size of the apparatus is larger when applying the airflow Af from immediately lateral to the syringe 1, the size of the apparatus can be made small by obliquely arranging the tube 14 in this configuration. Additionally, in this configuration, a deposit is formed on a level substrate and flexure is less likely to occur in the deposit.

Embodiment 3

Figure 4:
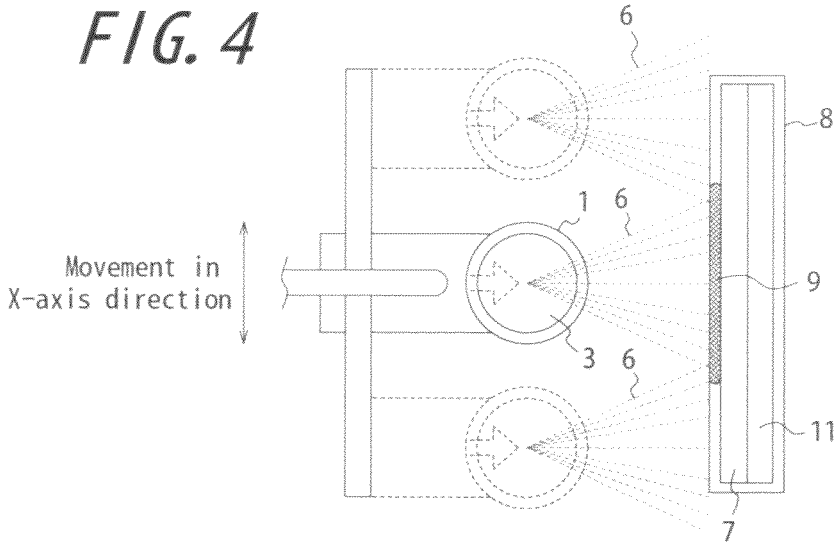
FIG. 4 is a conceptual view (top view) showing a basic configuration of an immobilization apparatus according to another embodiment of the invention.

FIGS. 3 and 4 are conceptual views each showing a basic configuration of an immobilization apparatus according to another embodiment of the invention. The apparatus shown in FIGS. 3 and 4 are different from the apparatus shown in FIG. 1 mainly in that the syringe 1 and the tube 14 are configured to be driven on a planar surface parallel to the planar surface of the substrate 7. FIG. 3 explains a configuration in which the syringe 1 and the tube 14 are drive in the Y-axis direction (vertical direction) and FIG. 4 explains a configuration in which the syringe 1 and the tube 14 are drive in the X-axis direction (horizontal direction). As seen from the figures, in this embodiment, the syringe 1 and the tube 14 are provided so that they can be independently driven by a driving means in the Y-axis direction and a driving means in the X-axis direction. The syringe 1 and the tube 14 change a position where the particulate substance 6 is deposited by changing the relative positional relationship with the substrate 7. For example, even when the flying direction of the particulate substance 6 lacks in uniformity, the syringe 1 and the tube 14 have an effect that deposition of the particulate substance 6 is uniformized by changing the relative positional relationship with the substrate 7.

In addition, although an example of simultaneously driving the syringe 1 and the tube 14 in this embodiment, a configuration of independently driving the syringe 1 and the tube 14 is also possible. In such a configuration, the relative positional relationship between the nozzle 4 of the syringe 1 and a ventilation opening of the tube 14 changes so as to change the scattering state of the particulate substance 6, to thereby make a further variety of adjustments possible.

Embodiment 4

Figure 5:
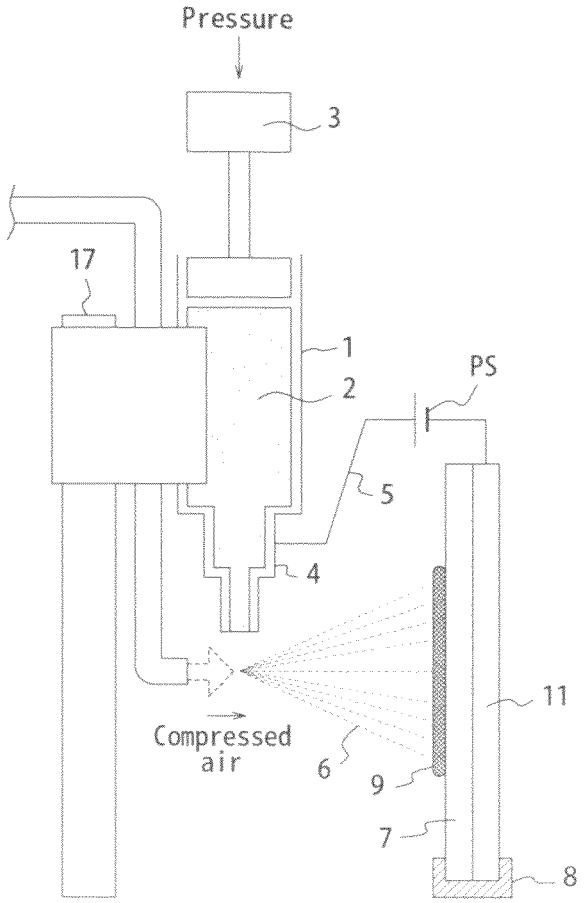
FIG. 5 is a conceptual view (side view) showing a basic configuration of an immobilization apparatus according to another embodiment of the invention.
Figure 6:
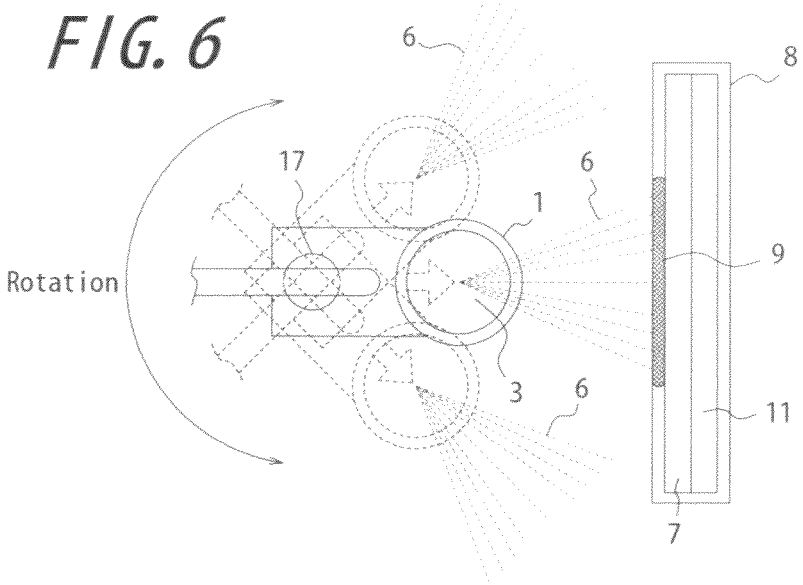
FIG. 6 is a conceptual view (top view) showing a basic configuration of an immobilization apparatus according to another embodiment of the invention.

FIGS. 5 and 6 are conceptual views each showing a basic configuration of an immobilization apparatus according to another embodiment of the invention. The apparatus shown in FIGS. 5 and 6 are different from the apparatus shown in FIG. 1 mainly in that the syringe 1 and the tube 14 are configured to be driven and oscillated around a fulcrum shaft 17. FIG. 5 is a view of a configuration of this embodiment seen from the lateral direction of the fulcrum shaft as a rotary shaft and FIG. 4 is a view of a configuration of this embodiment seen from above the fulcrum shaft 17. As seen from the figures, in this embodiment, angles of the syringe 1 and the tube 17 are changed so as to change the flying direction of the particulate substance 6. Namely, by changing the flying direction of the particulate substance 6, it is possible to change the depositional position of the particulate substance 6 on the substrate 7. This also has the effect of uniformizing deposition of the particulate substance 6.

In addition, a configuration of this embodiment and Embodiment 3 in combination, in which the syringe 1 and the tube 14 are moved in parallel, and driven and oscillated is also possible.

Embodiment 5

Figure 7:
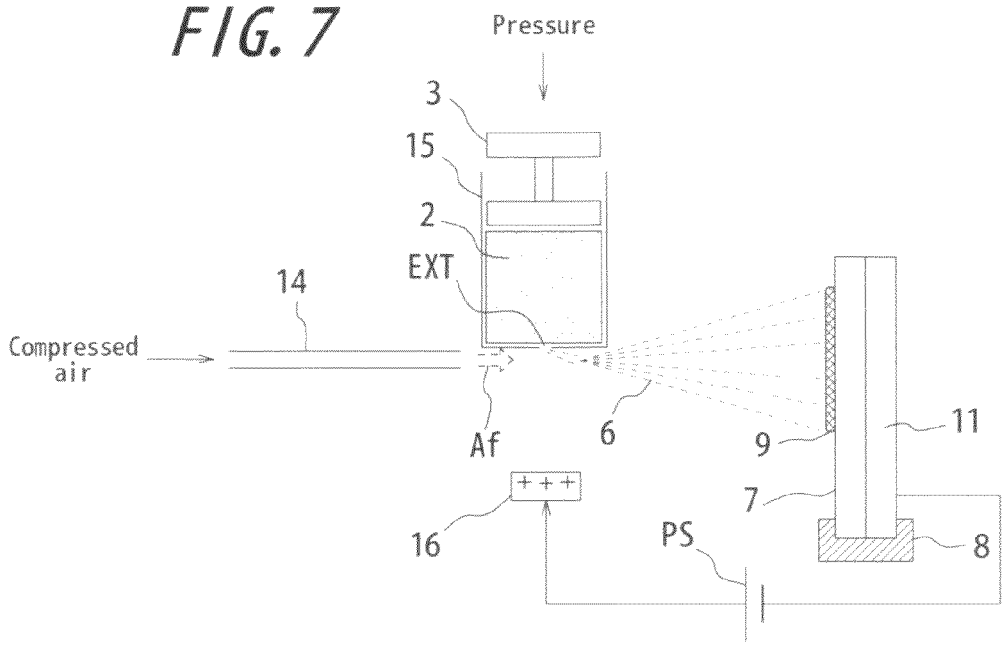
FIG. 7 is a conceptual view showing a basic configuration of an immobilization apparatus according to another embodiment of the invention.

FIG. 7 is a conceptual view showing a basic configuration of an immobilization apparatus according to another embodiment of the invention. The apparatus in FIG. 7 is different from the one in FIG. 1 mainly in that a tank 15 is used instead of the syringe 1 and the exhaust outlet EXT is provided instead of the nozzle in a bottom surface of the tank 15. An electrostatic induction apparatus 16 is further provided to be opposed to the exhaust outlet EXT provided on the bottom surface of the tank 15. The positive electric potential is supplied to the electrostatic induction apparatus 16. The electrostatic induction apparatus (electrode, etc.) 16 can charge the sample solution 2 without contacting the tank 15 or a sample solution. Thus, the electrostatic induction apparatus 16 indirectly charges a sample solution by the electrostatic induction, by placing a member such as an electrode with a high voltage applied thereto in the vicinity of the nozzle 4. A sample solution is charged at the location of the exhaust outlet EXT before the spray. The counter electrode 11 is also arranged in the extension direction of the airflow Af for the high velocity airflow Af coming from the side. This configuration, in which a container is used as substitute for a syringe, is more suitable for mass production. Moreover, since a container has many flat portions, a plurality of exhaust outlets can be provided easily. Therefore, the more the number of exhaust outlets is increased, the more the number or the amount of deposits produced per time can be increased.

Additionally, the tube 14 and the tank 15 may be configured to be driven on a planar surface in parallel to the planar surface of the substrate 7 in this embodiment. Furthermore, the tube 14 and the tank 15 may be configured to be driven and oscillated around the center.

Embodiment 6

Figure 8:
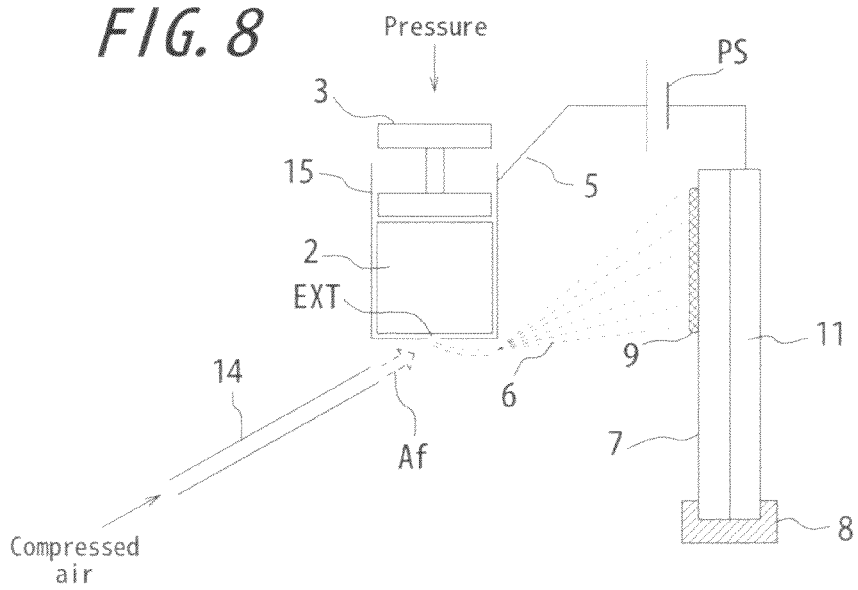
FIG. 8 is a conceptual view showing a basic configuration of an immobilization apparatus according to another embodiment of the invention.

FIG. 8 is a conceptual view showing a basic configuration of an immobilization apparatus according to another embodiment of the invention. The main difference between the apparatus in FIG. 8 and the one in FIG. 7 in that while the airflow Af spouts from the immediate lateral direction of a nozzle in FIG. 7, it is configured to spout from obliquely downside in FIG. 8. Furthermore, the tank 15 is made conductive and connected to the wire 5, and the sample solution 2 is charged via the tank 15. Thus, since the airflow Af hits the exhaust outlet EXT from obliquely downside, the kinetic energy of the airflow Af can be transferred to the sample solution 2 more efficiently, and thereby the crash energy becomes higher. Therefore, the atomization velocity and the atomization efficiency increase, and it becomes possible to make a liquid drop finer.

Embodiment 7

Figure 9:
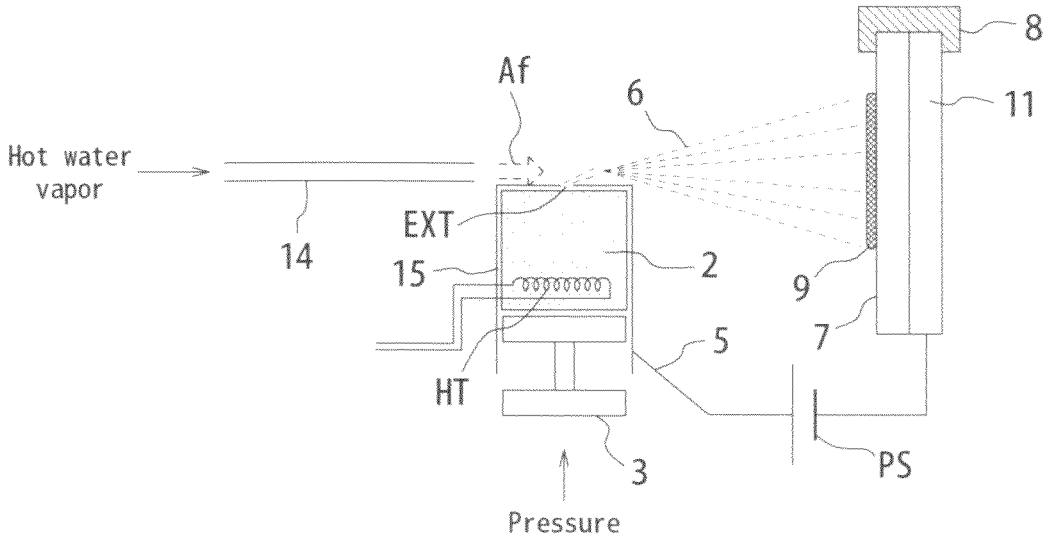
FIG. 9 is a conceptual view showing a basic configuration of an immobilization apparatus according to another embodiment of the invention.

FIG. 9 is a conceptual view showing a basic configuration of an immobilization apparatus according to another embodiment of the invention. The apparatus in FIG. 9 is different from the one in FIG. 7 in that the exhaust outlet EXT of the tank 15 is arranged at the upper side. The advantage of arranging an exhaust outlet at the upper side is that the exhaust rate can be regulated in a state without dripping caused by the weight of a solution itself. Moreover, in this embodiment, the high temperature air flow Af is used by using hot water vapor instead of compressed air. Furthermore, the tank 15 is provided with a heater HT to heat the sample solution 2 to be in a melting state. According to this configuration, it becomes possible to spray and immobilize a substance, which is even solid or gel-like at normal temperature. Therefore, according to this configuration, it becomes possible to produce a deposit by using a substance or a material, which cannot conventionally be used as a solvent or a sample.

Embodiment 8

Figure 10:
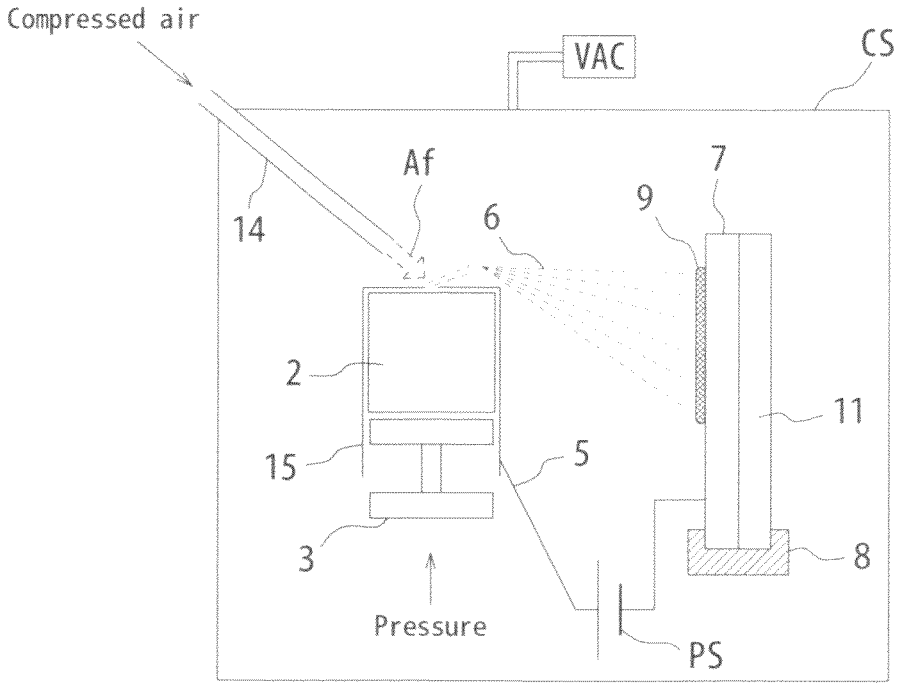
FIG. 10 is a conceptual view showing a basic configuration of an immobilization apparatus according to another embodiment of the invention.

FIG. 10 is a conceptual view showing a basic configuration of an immobilization apparatus according to another embodiment of the invention. The main difference between the apparatus in FIG. 10 and the one in FIG. 9 is in that while the direction of the airflow Af spouts from immediate lateral to a nozzle in FIG. 9, it is configured to spout from obliquely upside in FIG. 10. Also, as shown, the entire apparatus is stored in a case CS and a space where atomization occurs is depressurized by a vacuum pump VAC. By depressurizing a space where atomization occurs, it becomes possible to further accelerate evaporation of a solvent and increase the atomization rate to thereby immobilize a sample in a higher state of the activity and the functionality.

Furthermore, when the entire apparatus is stored in a case CS as the configuration of this embodiment, it is possible to uniformly heat all the apparatus (sample solution 2, tank 15, tube 14, substrate 7, etc.) within the case. As a result, a deposit can be formed more stably.

Embodiment 9

Figure 11:
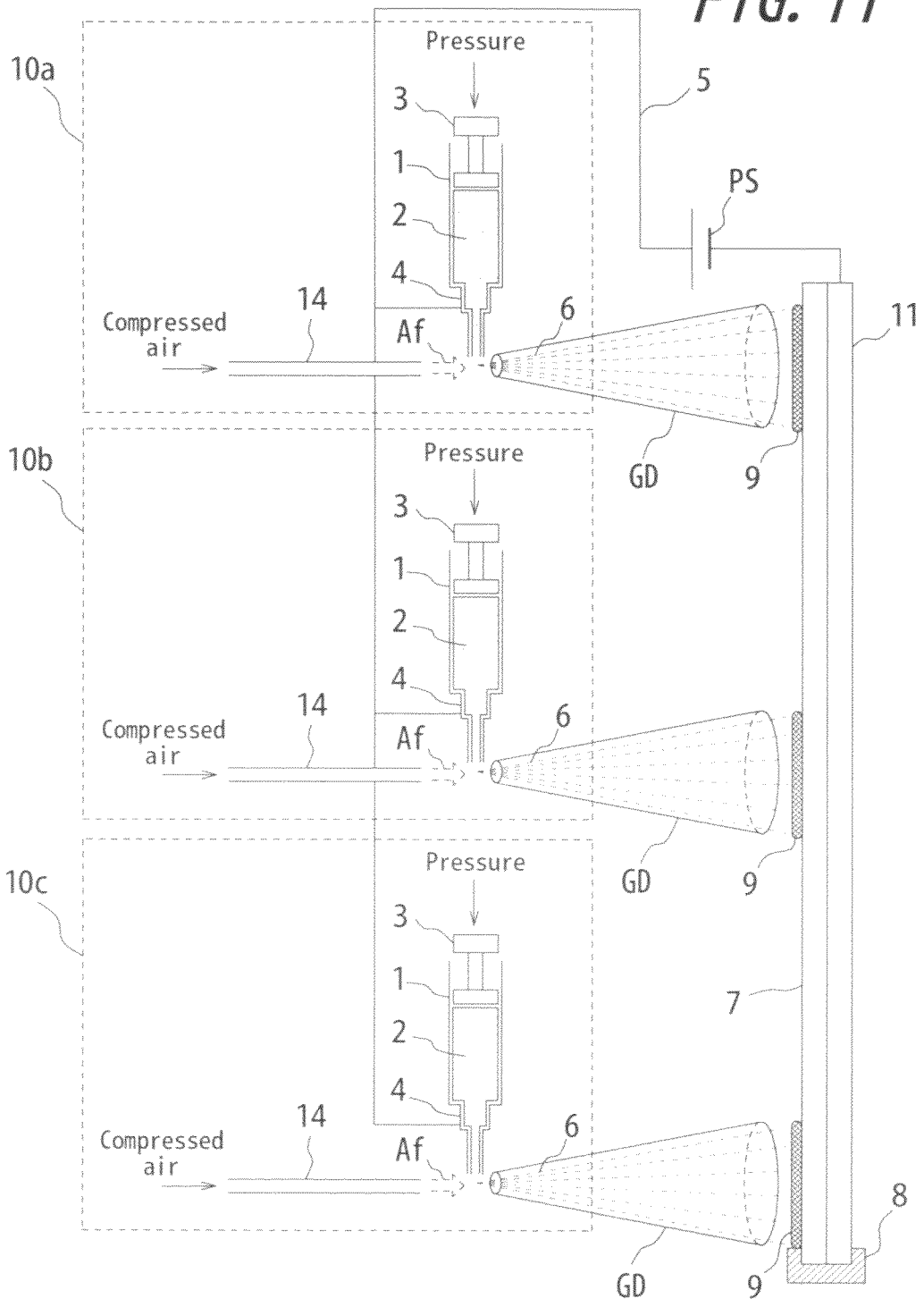

FIG. 11 is a conceptual view showing a basic configuration of an immobilization apparatus according to another embodiment of the invention. As shown, the apparatus comprises three atomization units 10*a*, 10*b* and 10*c*. Each of the atomization units 10*a*, 10*b* and 10*c* of this embodiment has a configuration in which the sample solution 2 is stored in the syringe 1, pressurized by the plunger 3, the sample solution 2 is exhausted through the nozzle 4, and compressed air is spurted from the tube 14. Namely, each of the atomization units 10*a*, 10*b* and 10*c* has the configuration described in Embodiment 1. Thus, it is possible to provide a number of atomization units in this configuration, which is suitable for mass production. Furthermore, in Embodiment 9, a guide GD for guiding the airflow Af containing a sprayed sample solution/particulate substance to the substrate 7 is provided between the nozzle 4 and the substrate 7. By the guide GD, it becomes possible to effectively guide the airflow Af (i.e., sprayed sample solution/particulate substance) to the objective depositional area.

Embodiment 10

Figure 12:
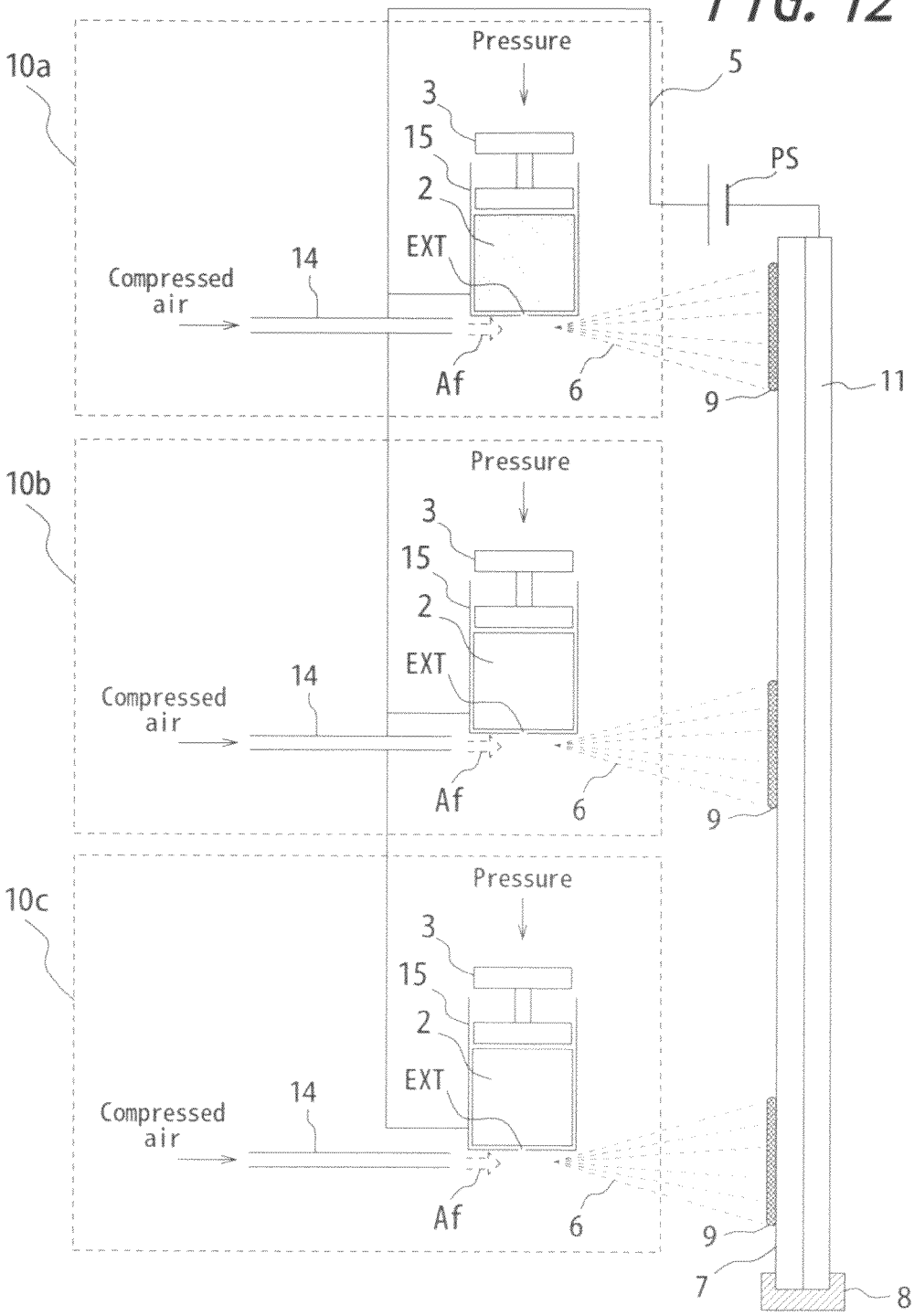
FIG. 12 is a conceptual view showing a basic configuration of an immobilization apparatus according to another embodiment of the invention.

FIG. 12 is a conceptual view showing a basic configuration of an immobilization apparatus according to another embodiment of the invention. The apparatus in FIG. 12 is different from the one in FIG. 11 mainly in that the exhaust outlet EXT is provided as substitute for a nozzle in the bottom surface of the tank 15 and besides, the tank 15 is made conductive. Namely, in this embodiment, three atomization units 10*a*, 10*b* and 10*c* each has a configuration corresponding to Embodiment 5. Thus, this configuration can also comprise a number of atomization units and is suitable for mass production.

Embodiment 11

Figure 13:
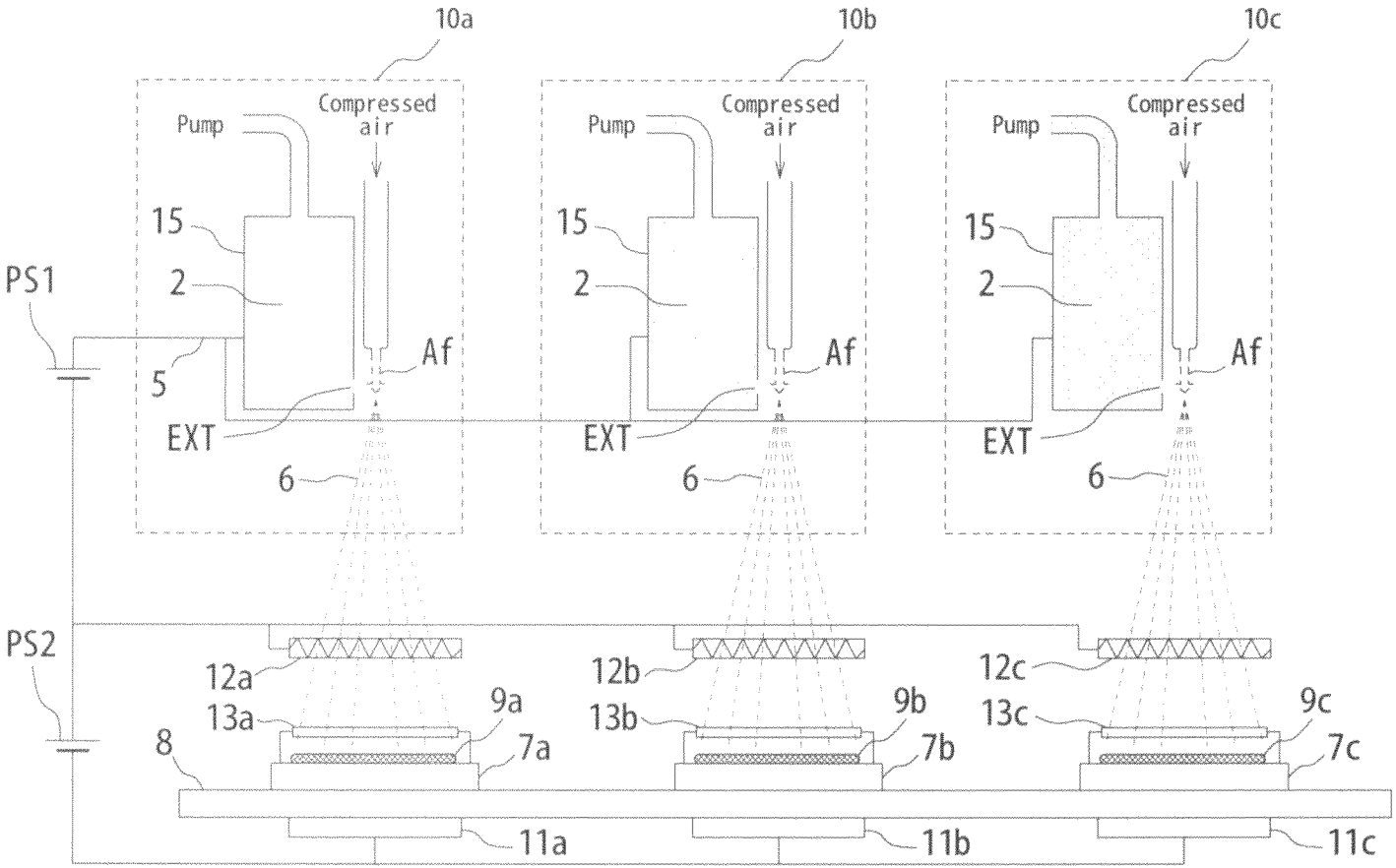
FIG. 13 is a conceptual view showing a basic configuration of an immobilization apparatus according to another embodiment of the invention.

FIG. 13 is a conceptual view showing a basic configuration of an immobilization apparatus according to another embodiment of the invention. As shown in FIG. 13, in this configuration, the exhaust outlet EXT is provided in the lateral side of the tank 15. Also, a sample solution is regulated to have a desired flow rate and a desired fluid pressure and supplied by a pump (not shown). The flow rate and the air pressure of the airflow Af of this configuration can be regulated in accordance with the kind and the viscosity of the solution. By combining these two regulations, it becomes possible to regulate the atomization rate/immobilization rate easily.

As shown, the immobilization apparatus of this embodiment comprises three atomization units 10*a*, 10*b* and 10*c*. Thus, this apparatus can also comprise a number of atomization units and can be used for mass production.

Also, in this configuration, doughnut-shaped electrodes 12*a-c* and masks 13*a-c* are further provided as a guide mechanism/collecting means for collecting or guiding liquid drops. Two voltages of the high voltage power supplies PS1 and PS2 are applied to the tanks 15*a-c*. A voltage supplied from the high voltage power supply PS2 is applied to the doughnut-shaped electrode (collimator ring). The electrosprayed particles, which are charged with a high voltage, fly towards a counter electrode with the large potential difference with the particles themselves. When passing through the ring of the doughnut-shaped electrode on the way, the atomized particles are narrowed down to the center of the ring by the high voltage repulsive force of the doughnut-shaped electrode, so that the collection efficiency for atomized liquid drops can be improved.

Moreover, the masks 13*a-c* provided on the substrates 7*a-c* can be each hollowed out to be a desired depositional pattern by an insulator such as fluorine resin to further improve the collection efficiency so as to deposit a sample in a desired pattern as deposits 9*a-c*. By making a mask of insulator, the same charge as the flying particles occurs to the mask, and the flying particles receive the repulsion from the mask and focus on the shape of the depositional pattern. Then, they are deposited in the shape of the pattern. Thereby, the collection efficiency can be improved.

Furthermore, the masks 13*a-c* provided on the substrates 7*a-c* may be composed of a conductor such as a metal. The masks 13*a-c* made of conductor such as metal are in close contact with the substrates 7*a-c* and are equipotential to the substrates 7*a-c*. In this case, due to the charge attracting the particulate substance 6 as well as the substrates 7*a-c*, although the particulate substance 6 is deposited on the masks 13*a-c*, it is also possible to deposit the particulate substance 6 in the vicinity of the edges of the masks 13*a-c*. Namely, by making the masks 13*a-c* of conductor such as metal, it is possible to form a deposit with a sharp pattern.

Additionally, in any embodiment, a cylindrical or tubular guide for guiding the airflow Af to the substrate 7 may be provided as Embodiment 7.

Figure 14:
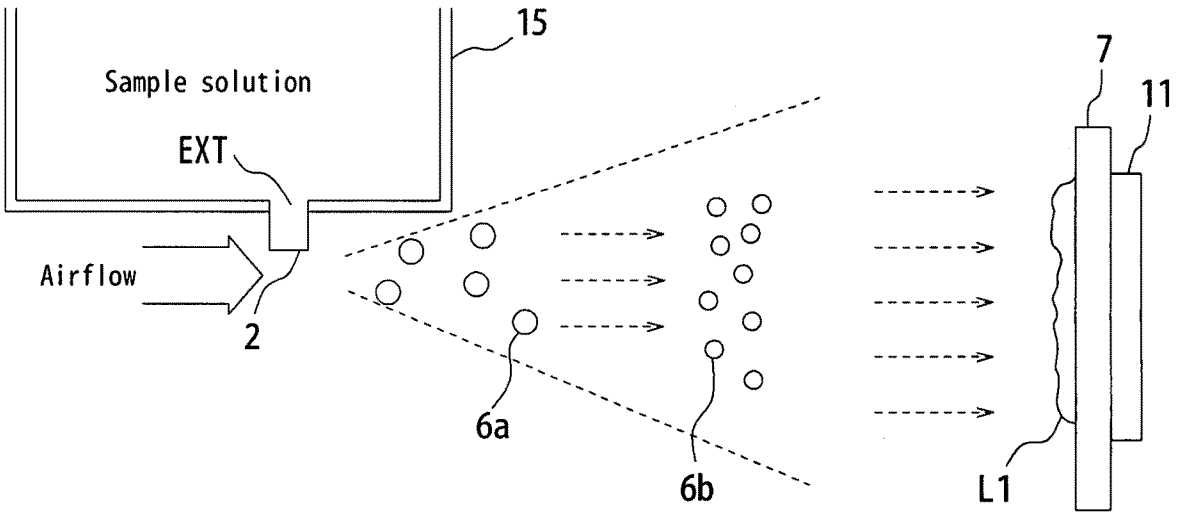
FIG. 14 is a schematic view showing the case when atomization is tried only by using airflow in an apparatus according to one embodiment of the invention.
Figure 15:
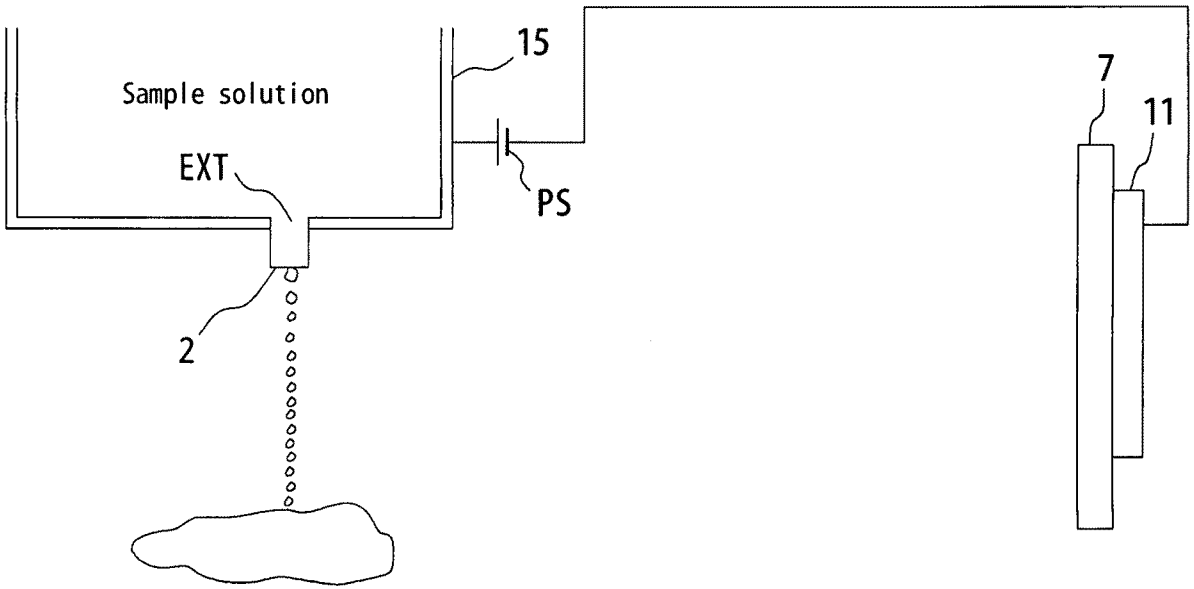
FIG. 15 is a schematic view showing the case when atomization is tried only by using voltage application in an apparatus according to one embodiment of the invention.
Figure 16:
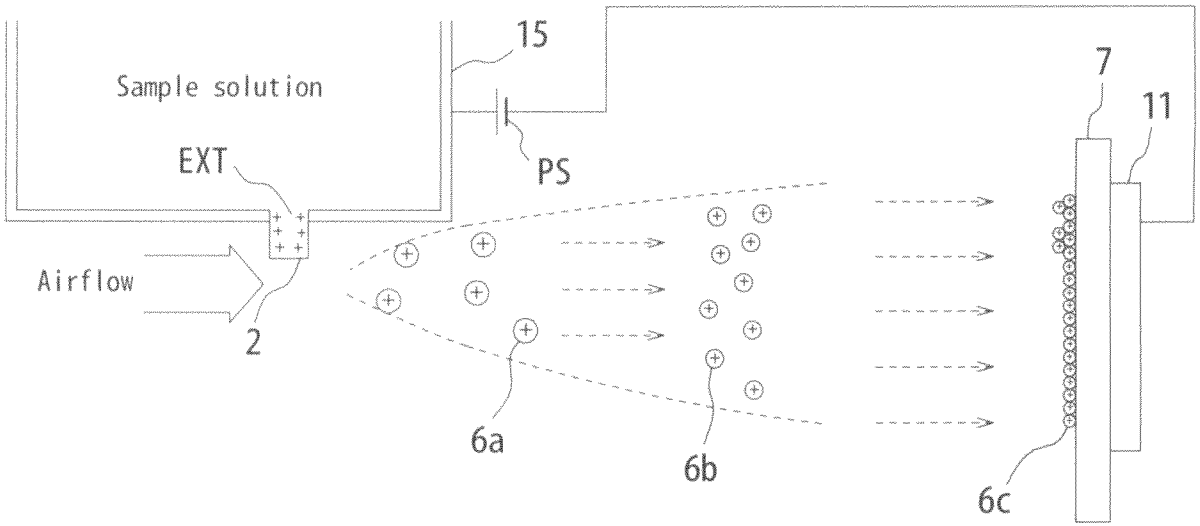
FIG. 16 is a schematic view showing an atomization principle of the invention.

FIG. 16 is a schematic view showing an atomization principle of the invention. FIG. 14 is a schematic view showing the case when atomization is tried only by using airflow in an apparatus according to one embodiment of the invention. FIG. 15 is a schematic view showing the case when atomization is tried only by using voltage application in an apparatus according to one embodiment of the invention. In each figure, the sample solution 2 stored in the tank 15 is exhausted from the exhaust outlet EXT provided in the bottom surface of the tank 15. In FIG. 16, the sample solution 2 within the tank 15 is positively charged by the high voltage power supply PS. Then, the sample solution 2 protruding from the exhaust outlet EXT is crashed into by airflow from the horizontal direction. The particle of the solution is atomized as a particulate substance 6*a* by the synergistic function of the kinetic energy of the airflow (this can be considered as the crash energy) and the electrostatic force of the sample solution 2. A particulate substrate 6*b* is dried while flying towards the substrate 7 (counter electrode 11).

The atomized particulate substance 6*a* decreases in particle size by being dried, further increases the electrostatic repulsion by the charge, repeats the division, and is further microsized. Also, the particulate substance 6*a* repeats the division and is further microsized by the kinetic energy (crash energy) while flying towards the substrate 7 (electrode 11 over the substrate, to be exact). Namely, as shown in FIG. 16, the particulate substance 6*a* decreases in particle size as shown as the particulate substance 6*b* in a distance about the middle of the exhaust outlet EXT and the substrate 7, and further decreases in particle size as shown as a particulate substance 6*c* when deposited on/absorbed to the substrate 7. The deposited particulate substance 6*c* (deposit) is in a dry or almost dry state and never loses the activity or the functionality. Although a deposit of a microstructure of nanoparticle is obtained in FIG. 16, a deposit can also be formed as a microstructure of microfiber (nonwoven cloth sheet, etc.).

In FIG. 14, since it is atomization only by airflow, it is only possible to make a liquid drop small to a degree as shown as the particulate substance 6*b*. Namely, only the crash energy by the kinetic energy of the airflow and the kinetic energy of the sample solution 2 exhausted from the exhaust outlet is used for atomization. Thus, it is difficult to make a particle size of the atomized particulate substance sufficiently fine and make the particulate substance be in a sufficiently dry state.

Therefore, a sufficiently dry deposit cannot be formed on the substrate 7 but a solution layer L1 as shown in FIG. 14 is formed. Namely, in the case of FIG. 14, a nanostructure is not formed and also a sample cannot be immobilized in a dry state. Moreover, in this case, the particulate substance, which is not charged, is never attracted to the counter electrode 11. Thus, the sample is not collected on the substrate 7 and is wasted.

In FIG. 15, since it is electrostatic atomization only by voltage application, when the diameter of the exhaust outlet EXT is too large, a solution only drops as shown and is difficult to be atomized. Also, even though the diameter of the exhaust outlet EXT is sufficiently small, when the exhaust rate of the solution is increased, the solution only drops as shown and cannot be atomized. Therefore, it is difficult to form a deposit with a sufficient size/thickness/amount on the substrate 7 in a short time.

On the other hand, in FIG. 16, it is possible to atomize a solution and produce a deposit with a sufficient size/thickness/amount in a good state in an extremely short time, without dropping the solution as shown even when the diameter of the exhaust outlet EXT is large and the exhaust rate increases.

Figure 17:
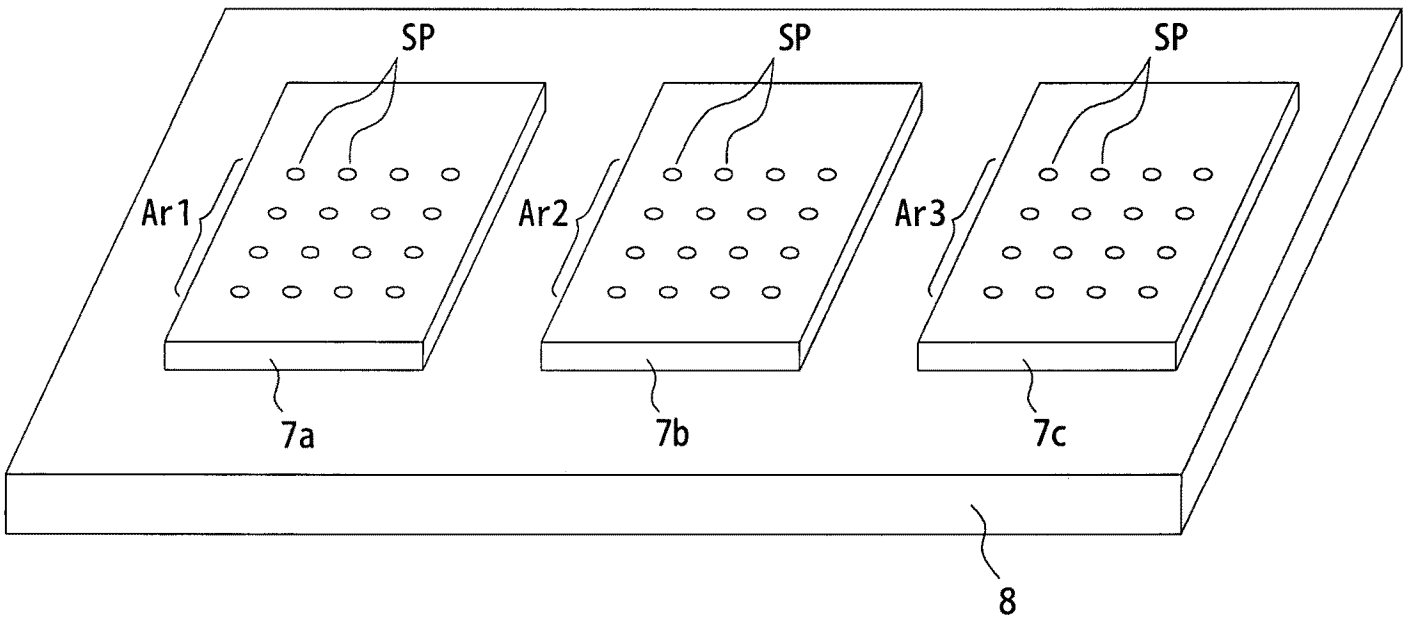
FIG. 17 is a view showing one example of a configuration in which arrayed spots/deposits are immobilized on a plurality of substrates.

FIG. 17 is a view showing one example of a configuration in which arrayed spots/deposits are immobilized on a plurality of substrates. As shown, the support portion 8 supports the substrates 7*a-c*. Spot arrays Ar1-3 of a plurality of spots SP immobilized are produced on the individual substrates. Thus, the apparatus according to the embodiments of the invention can also produce a plurality of arrays on a plurality of substrates. In order to produce a spot array on one substrate, a mask (not shown) having a particular pattern or a collimator ring (electrode, not shown) can be used to guide a sample/particle to a desired depositional location. Also, an electrode (not shown) imitating an array pattern may be provided on the backside of the substrate.

Figure 18:
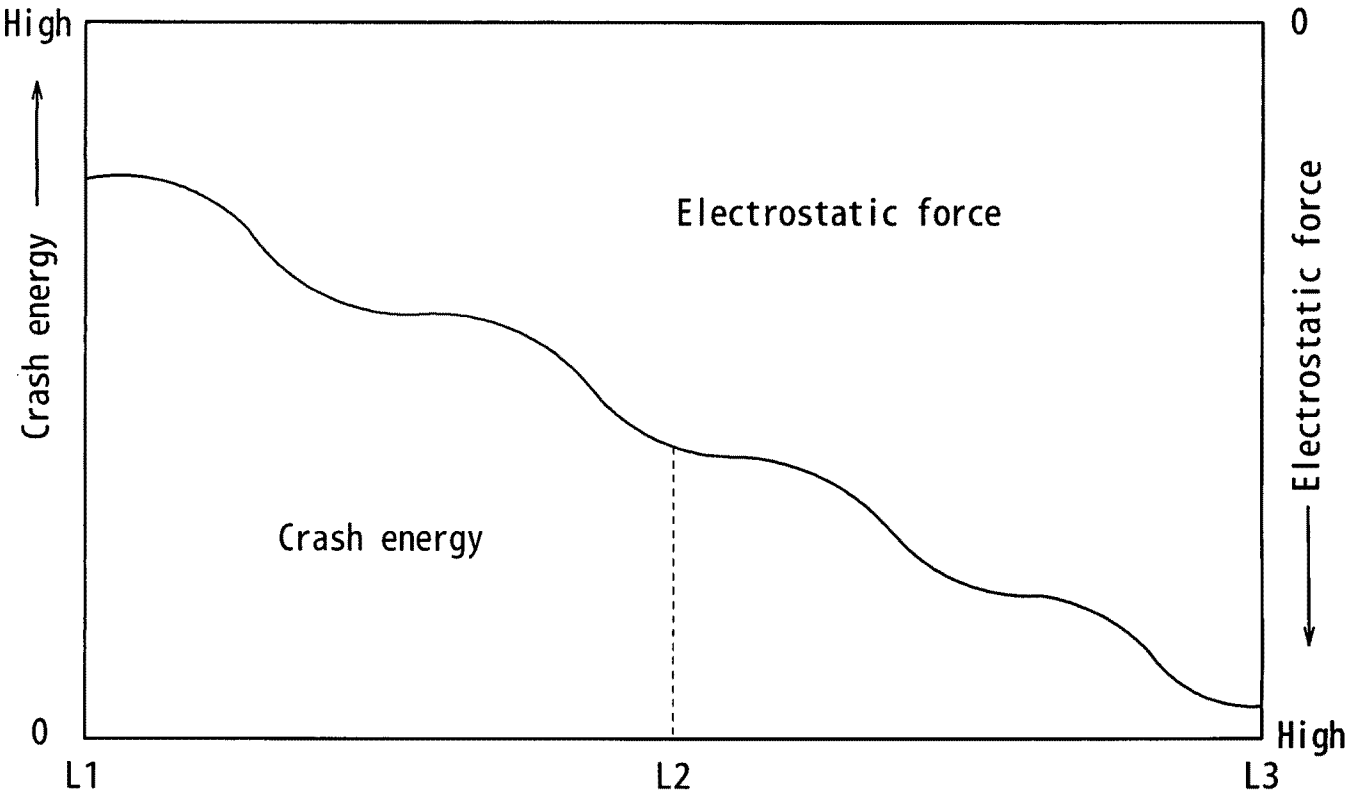
FIG. 18 is a schematic view showing an atomization principle of the invention.

FIG. 18 is a schematic view showing an atomization principle of the invention. A vertical line shows a state of the energy amount acting on liquid drops when flying out of a solution surface or more specifically atomization/liquid drop division while flying. The left vertical line shows the crash energy and the right vertical line shows the electrostatic force. Namely, as the energy acting on atomization/liquid drop division, the crash energy is dominant on the upper side of the vertical line, and the electrostatic force is dominant on the lower side of the vertical line. A horizontal line shows the location of liquid drops (may be considered as time transition after atomization). A location L1 on the left end is the initial stage of atomization, where the crash energy is dominant. When a solution is atomized and liquid drops fly towards a substrate, for example at the intermediate location L2, the crash energy and the electrostatic force are comparable. At a location L3 of the substrate, the electrostatic force is dominant and liquid drops are divided mainly by the electrostatic force.

Figure 19:
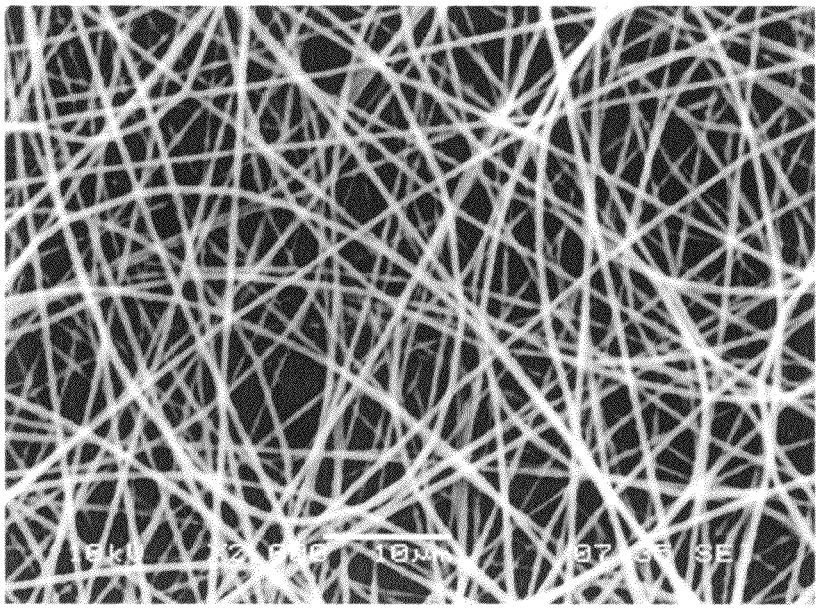
FIG. 19 is a photograph in place of a drawing showing a SEM image of a deposit (comparative example) produced by using an immobilization apparatus according to one embodiment of the invention.

FIG. 19 is a photograph in place of a drawing showing a SEM image of a deposit (comparative example) produced by using an immobilization apparatus according to one embodiment of the invention. This is a deposit produced by no airflow but voltage application (12 kV) only. The sample solution is an aqueous solution of 10 wt % of PVA (polyvinyl alcohol). It is possible to spray normally and obtain a structure in the form of nanofiber in a good state and in a dry state under the condition of 4 μL/min. Without airflow, the flow rate can be increased only up to 4 μL/min as the condition of this example. When the exhaust flow rate is more than 4 μL/min, the solution drips off and it becomes impossible to spray normally.

Figure 20:
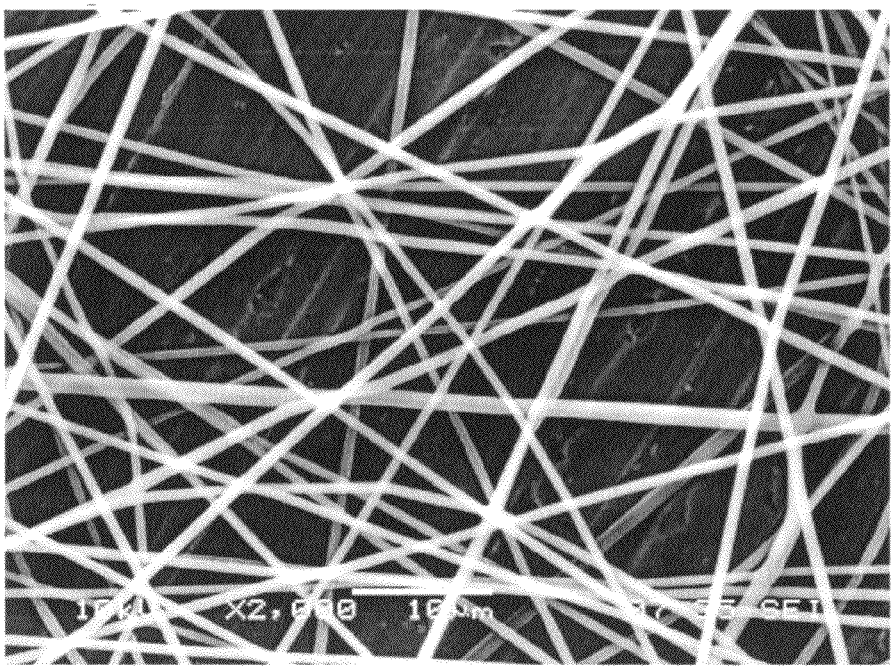
FIG. 20 is a photograph in place of a drawing showing a SEM image of a deposit (example) produced by using an immobilization apparatus according to one embodiment of the invention.

FIG. 20 is a photograph in place of a drawing showing a SEM image of a deposit (example) produced by using an immobilization apparatus according to one embodiment of the invention. This is a deposit produced under the condition that the air pressure of the airflow is 0.5 kg/cm$^2$, a voltage is applied (12 kV), and the flow rate is 100 μL/min. The sample solution is an aqueous solution of 10 wt % of PVA (polyvinyl alcohol). Although the flow rate can be increased only up to 4 μL/min without airflow, it is possible to spray normally and obtain a deposit of a structure in the form of nanofiber in a good state and in a dry state under this condition, even with the approximately twenty-fivefold flow rate as shown in FIG. 16.

Figure 21:
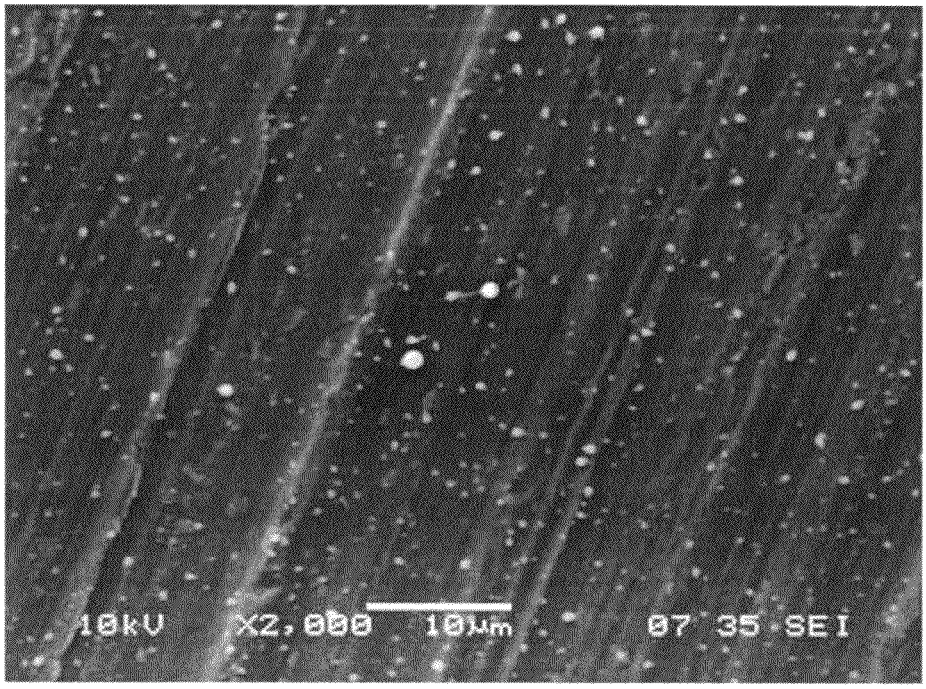
FIG. 21 is a photograph in place of a drawing showing a SEM image of a deposit (comparative example) produced by using an immobilization apparatus according to one embodiment of the invention.

FIG. 21 is a photograph in place of a drawing showing a SEM image of a deposit (comparative example) produced by using an immobilization apparatus according to one embodiment of the invention. This is a deposit produced by no airflow but voltage application (15 kV) only. The sample solution is an aqueous solution of 1 wt % of PVA (polyvinyl alcohol). It is possible to spray normally and obtain a deposit of nanparticle in a good state and in a dry state under the condition of 4 μL/min. Without airflow, the flow rate can be increased only up to 4 μL/min as the condition of this example. When the exhaust flow rate is more than 4 μL/min, the solution drips off and it becomes impossible to spray normally.

Figure 22:
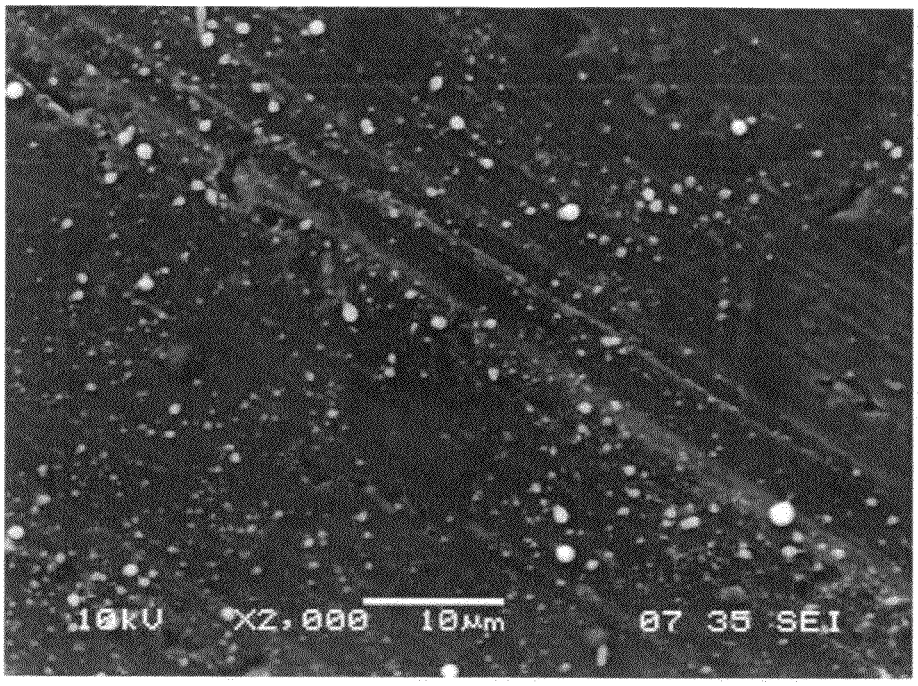
FIG. 22 is a photograph in place of a drawing showing a SEM image of a deposit (example) produced by using an immobilization apparatus according to one embodiment of the invention.

FIG. 22 is a photograph in place of a drawing showing a SEM image of a deposit (example) produced by using an immobilization apparatus according to one embodiment of the invention. This is a deposit produced under the condition that the air pressure of the airflow is 0.5 kg/cm$^2$, a voltage is applied (30 kV), and the flow rate is 50 μL/min. The sample solution is an aqueous solution of 1 wt % of PVA (polyvinyl alcohol). Although the flow rate can be increased only up to 4 μL/min without airflow, it is possible to spray normally and obtain a deposit of nanoparticle in a good state and in a dry state under this condition, even when the flow rate is 50 μL/min as shown in FIG. 22.

Figure 23:
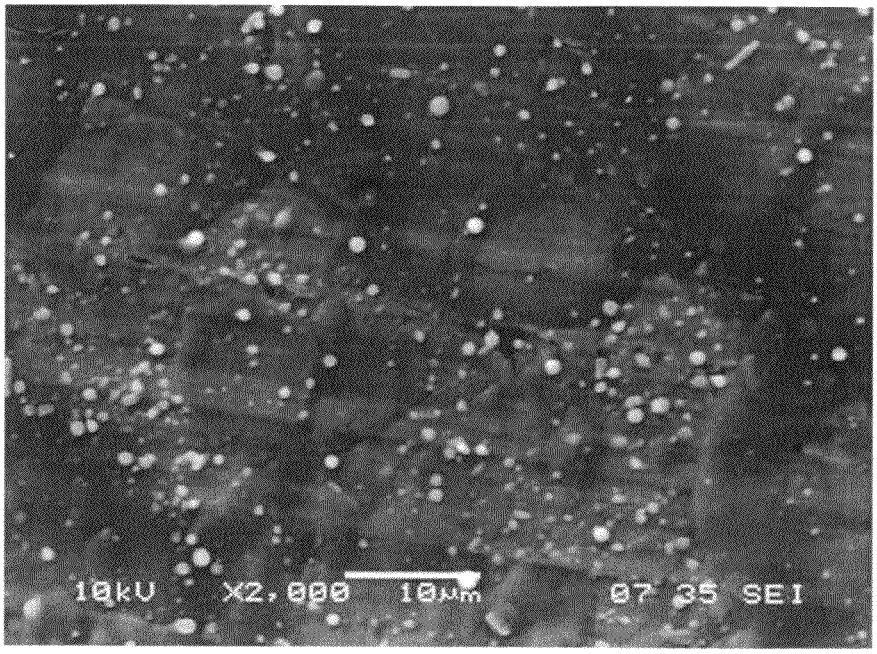
FIG. 23 is a photograph in place of a drawing showing a SEM image of a deposit (example) produced by using an immobilization apparatus according to one embodiment of the invention.

FIG. 23 is a photograph in place of a drawing showing a SEM image of a deposit (example) produced by using an immobilization apparatus according to one embodiment of the invention. This is a deposit produced under the condition that the air pressure of the airflow is 0.5 kg/cm$^2$, a voltage is applied (30 kV), and the flow rate is 100 μL/min. The sample solution is an aqueous solution of 1 wt % of PVA (polyvinyl alcohol). Although the flow rate can be increased only up to 4 μL/min without airflow, it is possible to spray normally and obtain a deposit of a structure of nanoparticle in a good state and in a dry state under this condition, even with the approximately twenty-fivefold flow rate as shown in FIG. 23.

Figure 24:
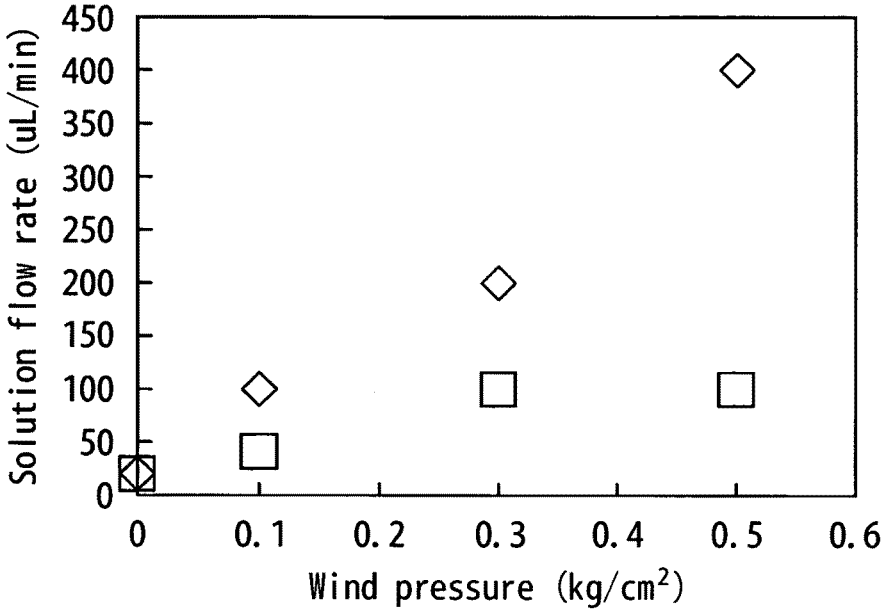
FIG. 24 is a graph showing the relationship between the solution flow rate (exhaust flow rate) and the wind pressure of airflow.

FIG. 24 is a graph showing the relationship between the solution flow rate (exhaust flow rate) and the wind pressure of airflow. A square is an example of the case where the wind pressure is increased without increasing the flow rate much. A diamond is an example of the case where the flow rate is increased. A deposit in a dry and uniform state can be produced in either case.

A deposit is produced by using an apparatus according to one embodiment of the invention under various conditions as below.

Comparative Example 1

No Voltage, Atomization Only by Airflow

Air pump: AS ONE
Air tube tip diameter: 1 mm
Air tube position: immediately below the nozzle
Sample solution: 10% PVA aqueous solution
Nozzle-substrate distance: 22.5 cm
Nozzle: 17 G (inner diameter: 1 mm)
Wind pressure: 0.5 kg/cm
Solution flow rate: 200 uL/min Under the condition of Comparative Example 1, a solution intermittently flies from the nozzle tip as liquid drops and a nanofiber is not formed. Also, liquid drops gather on the substrate in a wet state and are not immobilized in a dry state.

Comparative Example 2

No Voltage, Atomization Only by Airflow

Sample solution: 1% PVA aqueous solution
Nozzle: 27 G (inner diameter: 0.21 mm)
Wind pressure: 0.5 kg/cm
Solution flow rate: 100 uL/min In Comparative Example 2, although a solution flies from the nozzle tip in a misty state, a particle is not formed on the substrate and immobilization in a dry state is not possible, but in a wet state, i.e., a liquid pool is formed.

Example 1

With Voltage and Air Flow. Production of Deposit in the Form of Nonwoven Cloth

Air pump: AS ONE
Air tube tip diameter: 1 mm
Air tube position: immediately below the nozzle
Sample solution: 10% PVA aqueous solution
Nozzle-substrate distance: 22.5 cm
Nozzle: 17 G (inner diameter: 1 mm)
Wind pressure: 0.5 kg/cm
Solution flow rate: 200 uL/min Under the condition of Example 1, a solution can form a deposit of nanofiber on a substrate and immobilize a sample in a dry state.

Example 2

With Voltage and Airflow. Production of Particulate Deposit

Sample solution: 1% PVA aqueous solution
Nozzle: 27 G (inner diameter: 0.21 mm)
Wind pressure: 0.5 kg/cm
Solution flow rate: 100 uL/min In Example 2, a solution flies from the nozzle tip in a misty state and a nanoparticle can be immobilized on a substrate in a dry state.

Thus, the invention, which applies a novel atomization principle using two factors, the electrostatic force by voltage application and the crash energy (kinetic energy) of the airflow and a solution, can make liquid drops finer by the synergetic effect of these two factors, the voltage application and the crash of airflow. Moreover, it becomes possible to improve the atomization rate (immobilization rate, production rate) dramatically. Also, according to the configuration, it becomes possible to easily atomize and immobilize a solution, which is conventionally not suitable for electrostatic atomization due to problems in the velocity of the solution, the solubility of the solute and the electric conductivity.

The effect according to the embodiments of the invention will be described again. It is possible to form a thin film or a spot immobilized on a substrate extremely rapidly, while maintaining the activity of a sample, or more specifically without denaturalization or transubstantiation. For example, the invention can be used as a film forming apparatus or a micro array (DNA chip) producing machine (chip arrayer). Particularly, although a solution with high electric conductivity (in the case of containing a buffer solution with high electric conductivity, etc.) cannot be used in the conventional ESD method, since the apparatus of the invention uses the atomization mechanism by the synergetic effect of the electrostatic force and the crash energy, it becomes possible to use a solution with high electric conductivity. Namely, when a protein or the like is immobilized, a buffer solution holding a protein in a stable state does not need to be removed but can be used in the apparatus, so the operation time for forming a thin film becomes short. Therefore, the advantage is that a deposit of thin film or nonwoven cloth containing a sample with higher activity can be produced.

Although the invention has been described with reference to each drawing or example, it should be noted that it is easy for a person skilled in the art to make various modifications or alterations based on this disclosure. Therefore, it should be noted that these modifications and alterations are included in the scope of the invention. For example, it is possible to rearrange functions and the like included in each portion, means, step and the like unless being logically inconsistent, so it is possible to combine a plurality of means or steps in one or divide. Although the form of blowing the airflow against the exhaust outlet or the nozzle tip from some directions is explained in the embodiments, it is possible to configure the apparatus in various forms other than these. For example, it is also possible to implement the invention in the form of turning the exhaust outlet or the nozzle up. Although the form of using the counter electrode is explained in the examples, it may be a configuration of not using the counter electrode but grounding the substrate. Also, a compressed gas of nitrogen or rare gas other than compressed air may be used. As the sample solution, for example, a biopolymer solution such as a protein, an organic polymer solution, a polymer solution or the like can be used. In the airflow generating means, not only the compressed air but also a compressed nitrogen gas can be used as a gas. Moreover, the term "sample solution" in this specification is not limited to a "solution (i.e. water)" with a sample dissolved therein but includes the case where a sample is dissolved in a solvent (e.g., organic solvent such as ethanol, or inorganic solvent, etc.), or is not limited to a solution with a sample completely dissolved therein but includes the case where a sample is dispersed in water or a solvent.

The invention claimed is:

1. An immobilization apparatus comprising:

a container for storing a sample solution having at least one exhaust outlet formed for exhausting the sample solution;

a charging means for charging the sample solution within the container;

an airflow generating means for generating airflow crashing into the sample solution, wherein the immobilization apparatus is configured to operate the charging means and the airflow generating means simultaneously, atomize the solution into microparticulate substances charged while maintaining its activity and functionality by the electrostatic force due to the charge of the sample solution charged by the charging means and the crash energy due to the crash of the airflow generated by the airflow generating means into the sample solution, and exhaust it from the at least one exhaust outlet;

a supporting means for supporting a substrate, where the charged microparticulate substances are to be deposited by the electrostatic force, arranged away from the container; and an adjusting means for adjusting the relative positional relationship between the airflow generating means and the exhaust outlet of the container.

2. The immobilization apparatus according to claim 1, wherein the charging means is provided outside the container and induces a charge by the electrostatic induction to charge the sample solution stored in the container.

3. The immobilization apparatus according to claim 1, wherein the airflow generating means generates other airflow larger than the airflow.

4. The immobilization apparatus according to claim 1, further comprising a collecting means for collecting the atomized and charged microparticulate substances by the electrostatic force and guiding it to the substrate.

5. The immobilization apparatus according to claim 4, wherein the collecting means comprises one or a plurality of convergent electrodes arranged between the exhaust outlet of the container and the substrate.

6. The immobilization apparatus according to claim 4, wherein the collecting means comprises at least one mask of insulating body or dielectric body arranged between the exhaust outlet of the container and the substrate.

7. The immobilization apparatus according to claim 4, wherein at least a portion of the substrate surface is composed of a conductive substance, and the portion is grounded.

8. The immobilization apparatus according to claim 7, wherein the at least a portion of the surface of conductive substance is composed of an area with a desired pattern.

9. The immobilization apparatus according to claim 1, further comprising a temperature controlling means for controlling temperature of at least one of the sample solution, the container, the airflow and the substrate.

10. The immobilization apparatus according to claim 9, wherein the container, the charging means, the airflow generating means and the substrate are stored in a case, and the temperature controlling means controls temperature by heating inside the case.

11. The immobilization apparatus according to claim 1, further comprising a supplying means for supplying the sample solution to the container by an arbitrary flow rate.

12. The immobilization apparatus according to claim 1, further comprising a exhausting means for putting pressure on the sample solution stored in the container and exhausting the sample solution from the exhaust outlet by an arbitrary flow rate.

13. The immobilization apparatus according to claim 1, wherein the supporting means supports the substrate in an arbitrary direction to the exhaust outlet of the container.

14. The immobilization apparatus according to claim 1, wherein the airflow generating means comprises an airflow adjusting means for adjusting at least one of the flow rate, the velocity and the direction of the airflow.

15. The immobilization apparatus according to claim 1, further comprising a drying means for drying the particulate substances, wherein the drying means includes a means for supplying dry air to a space where the particulate substances exist and/or a means for depressurizing a space where the particulate substances exist.

16. The immobilization apparatus according to claim 1, wherein the container is a capillary, a tank, a box container or a syringe.

17. The immobilization apparatus according to claim 1, wherein the at least one exhaust outlet is a plurality thereof.

18. The immobilization apparatus according to claim 1, wherein the container is a plurality thereof.

19. The immobilization apparatus according to claim 18, wherein different sample solutions are stored in the plurality of the containers and media in the different sample solutions are deposited simultaneously on the substrate.

20. The immobilization apparatus according to claim 1, further comprising a guiding means for guiding the airflow to a particular area on the substrate.

21. The immobilization apparatus according to claim 1, further comprising a moving means for moving the supporting means.

22. The immobilization apparatus according to claim 1, further comprising a driving means for holding the airflow generating means and the container simultaneously, and driving the airflow generating means and the container on a planar surface parallel to the substrate.

23. The immobilization apparatus according to claim 1, further comprising an oscillating means for holding the airflow generating means and the container simultaneously and rotationally driving the airflow generating means and the container on an axis parallel to the substrate.

24. The immobilization apparatus according to claim 1, wherein a structure deposited on the substrate includes at least one of a nanofiber, a nanoparticle and a micropattern.

25. The immobilization apparatus according to claim 1, wherein a conductive mask for restricting a depositional area is provided on the substrate in close contact therewith.

26. An immobilization apparatus comprising:

a container for storing a sample solution having at least one exhaust outlet formed for exhausting the sample solution;

a charging means for charging the sample solution within the container;

an airflow generating means for generating airflow crashing into the sample solution, wherein the immobilization apparatus is configured to operate the charging means and the airflow generating means simultaneously, atomize the solution into microparticulate substances charged while maintaining its activity and functionality by the electrostatic force due to the charge of the sample solution charged by the charging means and the crash energy due to the crash of the airflow generated by the airflow generating means into the sample solution, and exhaust it from the at least one exhaust outlet;

a supporting means for supporting a substrate, where the charged microparticulate substances are to be deposited by the electrostatic force, arranged away from the container; and a driving means for holding the airflow generating means and the container independently, and driving the airflow generating means and the container on a planar surface parallel to the substrate independently.

27. An immobilization apparatus comprising:

a container for storing a sample solution having at least one exhaust outlet formed for exhausting the sample solution;

a charging means for charging the sample solution within the container;

an airflow generating means for generating airflow crashing into the sample solution, wherein the immobilization apparatus is configured to operate the charging means and the airflow generating means simultaneously, atomize the solution into microparticulate substances charged while maintaining its activity and functionality by the electrostatic force due to the charge of the sample solution charged by the charging means and the crash energy due to the crash of the airflow generated by the airflow generating means into the sample solution, and exhaust it from the at least one exhaust outlet;

a supporting means for supporting a substrate, where the charged microparticulate substances are to be deposited by the electrostatic force, arranged away from the container; and an oscillating means for holding the airflow generating means and the container independently and rotationally driving the airflow generating means and the container on an axis parallel to the substrate independently.

* * * * *